US011111756B2

(12) United States Patent
Killie et al.

(10) Patent No.: US 11,111,756 B2
(45) Date of Patent: Sep. 7, 2021

(54) VALVE AND A METHOD FOR CLOSING FLUID COMMUNICATION BETWEEN A WELL AND A PRODUCTION STRING, AND A SYSTEM COMPRISING THE VALVE

(71) Applicant: Innowell Solutions AS, Porsgrunn (NO)

(72) Inventors: Rune Killie, Skien (NO); Anders Beyer Brattli, Krokkleiva (NO)

(73) Assignee: Innowell Solutions AS, Porsgrunn (NO)

( * ) Notice: Subject to any disclaimer, the term of this patent is extended or adjusted under 35 U.S.C. 154(b) by 0 days.

(21) Appl. No.: 16/969,232

(22) PCT Filed: Dec. 14, 2018

(86) PCT No.: PCT/NO2018/050311
§ 371 (c)(1),
(2) Date: Aug. 12, 2020

(87) PCT Pub. No.: WO2019/160423
PCT Pub. Date: Aug. 22, 2019

(65) Prior Publication Data

US 2021/0002978 A1 Jan. 7, 2021

(30) Foreign Application Priority Data

Feb. 13, 2018 (NO) ..... 20180230

(51) Int. Cl.
*E21B 34/08* (2006.01)
*E21B 43/12* (2006.01)

(52) U.S. Cl.
CPC ..... *E21B 34/08* (2013.01); *E21B 43/12* (2013.01)

(58) Field of Classification Search
CPC ..... E21B 34/08; E21B 43/12
See application file for complete search history.

(56) References Cited

U.S. PATENT DOCUMENTS 7,185,706 B2 * 3/2007 Freyer ..... E21B 43/12 166/369
8,474,535 B2 * 7/2013 Richards ..... E21B 34/063 166/325

(Continued)

FOREIGN PATENT DOCUMENTS

NO 20161700 3/2018
WO 2011100176 8/2011

(Continued)

OTHER PUBLICATIONS

Norwegian Search Report for 20180230, dated Sep. 7, 2018.
International Search Report and the Written Opinion for PCT/NO2018/050311, dated Mar. 4, 2019.

*Primary Examiner* — Matthew R Buck
(74) *Attorney, Agent, or Firm* — Andrus Intellectual Property Law, LLP

(57) ABSTRACT

A valve, a system and a method are for closing fluid communication between a well and a production string when a content of an undesired fluid in the fluid flow exceeds a predetermined level. The valve has a primary flow channel having a primary inlet through a flow barrier, and a low pressure portion; a secondary flow channel having a secondary inlet through the flow barrier and provided with a flow restrictor; a chamber connected to the secondary flow channel; a piston for opening and closing the primary flow channel; and an inflow control element movable in response to a density of a fluid. The inflow control element is exposed to the fluid flow upstream of the flow barrier and moves to close the secondary inlet when the content of the undesired fluid exceeds the predetermined level, activating the piston and closing the valve.

19 Claims, 21 Drawing Sheets

(56) References Cited

U.S. PATENT DOCUMENTS

| | | | | |
|---|---|---|---|---|
| 8,708,050 | B2 * | 4/2014 | Dykstra | E21B 43/12 166/319 |
| 8,752,629 | B2 * | 6/2014 | Moen | E21B 34/08 166/321 |
| 9,453,395 | B2 * | 9/2016 | Fripp | E21B 43/12 |
| 9,556,706 | B1 | 1/2017 | Zhao | |
| 2007/0246407 | A1 | 10/2007 | Richards et al. | |
| 2008/0041580 | A1 | 2/2008 | Freyer et al. | |
| 2008/0041581 | A1 | 2/2008 | Richards | |
| 2008/0041582 | A1 | 2/2008 | Saetre et al. | |
| 2009/0151925 | A1 | 6/2009 | Richards et al. | |
| 2013/0068467 | A1 | 3/2013 | Zhou | |
| 2015/0060084 | A1 | 3/2015 | Moen et al. | |

FOREIGN PATENT DOCUMENTS

| | | |
|---|---|---|
| WO | 2013070235 | 5/2013 |
| WO | 2013139601 | 9/2013 |
| WO | 2014081306 | 5/2014 |
| WO | 2016033459 | 3/2016 |

* cited by examiner

B-B

C-C

D-D

VALVE AND A METHOD FOR CLOSING FLUID COMMUNICATION BETWEEN A WELL AND A PRODUCTION STRING, AND A SYSTEM COMPRISING THE VALVE

CROSS-REFERENCE TO RELATED APPLICATIONS

This application is the U.S. national stage application of International Application PCT/NO2018/050311, filed Dec. 14, 2018, which international application was published on Aug. 22, 2019, as International Publication WO 2019/160423 in the English language. The International Application claims priority of Norwegian Patent Application No. 20180230, filed Feb. 13, 2018. The international application and Norwegian application are both incorporated herein by reference, in entirety.

FIELD

The present invention relates to a valve and a system for use in a well. More particularly, the invention relates to a valve for closing inflow of various fluids that may be drained from a reservoir or utilized for preparing the well. The fluids may typically be prevented from being drained into a production string when a content of an undesired fluid in the fluid flow exceeds a predetermined level. In this document the term "level" means volume fraction of undesired fluid.

BACKGROUND

Undesired fluids might typically, but not exclusively, be gas or water. A person skilled in the art will appreciate that fluids regarded as desired or undesired will vary depending on the purpose of the well and the operational scenario.

Thus, one purpose of the invention is to control the inflow of various fluids that may be drained from a reservoir or utilized for preparing the well. In a well for producing gas or oil such fluids may be one or more of oil, gas and water which is drained from the reservoir, and also well construction fluids such as drilling fluid and completion fluids which are used when constructing the well prior to initial start-up of production from the well.

The valve and the system according to the invention are configured to discriminate between desired and undesired fluids when the undesired fluid exceeds a predetermined level. The invention may form part of an autonomous inflow control device (AICD). A plurality of AICDs may be distributed along a reservoir section of a well to block or restrict inflow of unwanted fluids from the reservoir, typically water and gas.

Modern long-reach horizontal production wells for oil and gas have the objective to increase the contact to a productive reservoir. Modern drilling, both offshore and onshore, is a costly operation as the initial cost of establishing a secure and cased wellbore down to the reservoir depth is mandatory, independent of the later well objective. Such wells might penetrate several thousands of meters of productive reservoir, and in order to establish desired productivity along these wellbores, proper removal of drilling fluids and other well construction fluids are required during the initial startup and clean-up of these wells.

Today, AICDs commonly used in the petroleum exploration industry are configured in such a way that they distinguish between unwanted fluids (normally gas and water) and wanted fluids (normally oil) based on differences in fluid viscosity. This results in different Re (Reynolds number—a dimensionless number that gives a measure of the ratio of inertial forces to viscous forces for given flow conditions) and therefore different flow characteristics, e.g. different pressure drop across a hydraulic restriction. A person skilled in the art will know that Reynolds number is a dimensionless number that gives a measure of the ratio of inertial forces to viscous forces for given flow conditions. These differences are then transformed into a force that controls the opening and closing of the AICD.

However, differences in Reynolds number are not necessarily caused by different viscosities. It can also be caused by differences in velocity. In a heterogeneous reservoir with large variations in permeabilities and local inflow rates along the reservoir, the velocity and therefore the Reynolds number can be very different in different AICDs along the reservoir. This becomes even more challenging if the objective is to distinguish between two fluids that only have a small difference in viscosity, like water and light oil.

The effective viscosity of a two-phase mixture (oil-gas or oil-water) is dominated by the viscosity of the continuous phase. This means that the effective viscosity of the mixture varies significantly near that inversion point (typically around 50% volume fraction), but not so much when approaching the one-phase limit (pure gas or pure water). It is often desirable to block or restrict the unwanted fluid only when its volume fraction approaches a high value close to 100%, for example 90%, but this will be challenging for AICDs based on viscosity differences as the effective viscosity of the mixture is practically insensitive to the volume fraction at high volume fractions.

Publication US2008041581 A1 discloses a fluid flow control apparatus for controlling the inflow of production fluids from a subterranean well. The apparatus includes a fluid discriminator section and a flow restrictor section that is configured in series with the fluid discriminator section such that fluid must pass through the fluid discriminator section prior to passing through the flow restrictor section. The fluid discriminator section comprises a plurality of free floating balls, each ball operable to autonomously restrict a hole and thereby at least a portion of an undesired fluid type, such as water or gas, from the production fluids. The flow restrictor section is operable to restrict the flow rate of the production fluids, thereby minimizing the pressure drop across the fluid discriminator section.

The publication US2007246407 discloses inflow control devices for sand control screens. A well screen includes a filter portion and at least two flow restrictors configured in series, so that fluid which flows through the filter portion must flow through each of the flow restrictors. At least two tubular flow restrictors may be configured in series, with the flow restrictors being positioned so that fluid which flows through the filter portion must reverse direction twice to flow between the flow restrictors. US2007246407 also discloses a method of installing a well screen wherein the method includes the step of accessing a flow restrictor by removing a portion of an inflow control device of the screen. US2007246407 suggests a plurality of free-floating balls in annular chambers. If the fluid flowing through the chamber has the same density as the balls, the balls will start to flow along with the fluid. Unless a ball is trapped inside a recirculation zone, it will eventually be carried to an exit hole, which it blocks. Suction force will cause the ball to block the hole continuously until production is stopped. A production stop will cause pressure equalization, such that the ball can float away from the hole. The free-floating balls block a main flow passage.

Publication US20080041580 discloses an apparatus for use in a subterranean well wherein fluid is produced which includes both oil and gas. The apparatus comprises: multiple first flow blocking members, each of the first members having a density less than that of the oil, and the first members being positioned within a chamber so that the first members increasingly restrict a flow of the gas out of the chamber through multiple first outlets. The flow blocking members block a main flow passage.

Publications US2008041582 discloses an apparatus which is based on the same principles as US20080041580 mentioned above.

Publication US20130068467 discloses an inflow control device for controlling fluid flow from a subsurface fluid reservoir into a production tubing string, the inflow control device comprising: a tubular member defining a central bore having an axis, wherein upstream and downstream ends of the tubular member may couple to the production tubing string; a plurality of passages formed in a wall of the tubular member; an upstream inlet to the plurality of passages leading to an exterior of the tubular member to accept fluid; each passage having at least two flow restrictors with floatation elements of selected and different densities to restrict flow through the flow restrictors in response to a density of the fluid; at least one pressure drop device positioned within each passage in fluid communication with an outflow of the flow restrictors, the pressure drop device having a pressure piston for creating a pressure differential in the flowing fluid based on the reservoir fluid pressure; and wherein an outflow of the pressure drop device flows into an inflow fluid port in communication with the central bore.

Publication WO2014081306 discloses an apparatus and a method for controlling fluid flow in or into a well. The apparatus includes at least one housing having an inlet and at least one outlet, one of which is arranged in a top portion or a bottom portion of the housing when in a position of use, and a flow control means disposed within the housing. The flow control means has a density that is higher or lower than a density of a fluid to be controlled and a form adapted to substantially block the outlet of the housing when the flow control means is in a position abutting the outlet.

In the prior art apparatuses referred above, the unwanted fluid, such as gas or water, is blocked by means of flow control elements arranged in a main flow path. Thus, it is difficult for the apparatus to control where an interface of the wanted and unwanted fluid is located.

Publications US20150060084 A1 and W02016033459 A1 disclose a flow control device to improve a well operation, such as a production operation. A flow control device has a valve positioned in a housing for movement between flow positions. The different flow positions allow different levels of flow through a primary flow port. At least one flow regulation element is used in cooperation with and in series with the valve to establish a differential pressure acting on the valve. The differential pressure is a function of fluid properties and is used to autonomously actuate the flow control device to an improved flow position. Different fluids with different viscosities or Reynolds numbers have different flow characteristics and pressure drop through the secondary flow path, which means that the piston can open for wanted fluid and close for unwanted fluid.

Publication WO 2013139601 discloses a fluid flow control device comprising a housing having a fluid inlet and at least one fluid outlet. A first fluid flow restrictor serving as an inflow port to a chamber in the housing, and a second fluid flow restrictor serving as an outflow port from the chamber. The first fluid flow restrictor and the second fluid flow restrictor are configured to generate different fluid flow characteristics. The chamber comprises actuating means that is responsive to fluid pressure changes in the chamber. The first fluid flow restrictor and the second fluid flow restrictor are configured to impose its respective different fluid flow characteristics. The device is sensitive inter alia to Reynolds number.

Publication US2009151925 discloses a well screen inflow control device with check valve flow controls. A well screen assembly includes a filter portion and a flow control device which varies a resistance to flow of fluid in response to a change in velocity of the fluid. Another well screen assembly includes a filter portion and a flow resistance device which decreases a resistance to flow of fluid in response to a predetermined stimulus applied from a remote location. Yet another well screen assembly includes a filter portion and a valve including an actuator having a piston which displaces in response to a pressure differential to thereby selectively permit and prevent flow of fluid through the valve.

Publication NO20161700 discloses an apparatus and a method for controlling a fluid flow in, into or out of a well, the apparatus comprising: a main flow channel having an inlet and an outlet being in fluid communication with the fluid flow; at least one chamber arranged in fluid communication with the main flow channel, the chamber having at least one flow control element movable between a first non-blocking position and a second blocking position for the fluid flow between the inlet and the outlet of the main flow channel, the flow control element movable in response to density of fluid in said chamber. The main flow channel is provided with pressure changing means causing a pressure differential in a fluid return conduit providing fluid communication between said chamber and a portion of the main flow channel, so that fluid in said chamber is recirculated back to the main flow channel when the main flow channel is open, and an orientation means for orienting the apparatus in the well. NO20161700 suggests ejectors to remove accumulations of undesired fluids, such that the valve will close at higher volume fractions of unwanted fluids. The apparatus and method disclosed in NO20161700 has proven to function satisfactorily. The flow control elements are configured to operate in a main flow path through the apparatus, and the drag forces acting on the flow control elements are thus sensitive inter alia to Reynolds number.

There is a need for a valve, hereinafter also denoted an AICD, that operates independently of fluid viscosity, local velocity and Reynolds number, and that is also capable of reliably blocking or restricting the unwanted fluid for all flow rates once the volume fraction of the unwanted fluid exceeds a pre-defined limit.

SUMMARY

The invention has for its object to remedy or to reduce at least one of the drawbacks of the prior art, or at least to provide a useful alternative to prior art.

The object is achieved through features, which are specified in the description below and in the claims that follow.

The invention is defined by the independent patent claims. The dependent claims define advantageous embodiments of the invention.

In a first aspect of the invention there is provided a valve suitable for closing fluid communication between a well and a production string when a content of an undesired fluid in the fluid flow exceeds a predetermined level, the valve comprising:

a primary flow channel having a primary inlet through a flow barrier, and a low pressure portion;

a secondary flow channel connected to the primary flow channel at the low pressure portion, the secondary flow channel having a secondary inlet through the flow barrier and provided with a flow restrictor;

a chamber in connection with the secondary flow channel;

a piston arranged in the primary flow channel for opening and closing the primary flow channel, the piston defining a portion of the chamber in connection with the secondary flow channel;

an inflow control element movable between a first position and a second position in response to a density of a fluid;

wherein the inflow control element is exposed to the fluid flow upstream of the flow barrier and is arranged to move to the second position and close the secondary inlet when the content of the undesired fluid in the flow upstream of the flow barrier exceeds the predetermined level; and wherein the closing of the secondary inlet causes an underpressure in the chamber such that the piston is activated and the valve is closed.

By the term "low pressure portion" is meant a portion of the primary flow channel wherein the pressure of a flowing fluid is lower than the fluid pressure upstream of the barrier.

Thus, the position of the piston depends on whether fluid is flowing into the secondary flow channel or not, which flow depends on the content, or volume fraction, of the undesired fluid in the flow upstream of the barrier and a position of the inflow control element with respect to the secondary inlet. By the term upstream is meant fluid "abutting" or being adjacent the barrier.

The operation of the valve according to the invention depends on the density of the fluid flow upstream of the flow barrier only, and is thus independent of fluid viscosity, velocity of the flowing fluid and Reynolds number.

The predetermined level may be set by means of a hydraulic resistance of the secondary flow channel, i.e. a configuration of the apparatus. The secondary inlet of the secondary flow channel forms a fluid inlet of the chamber. The outlet of the chamber is formed by the connection between the secondary flow channel and the primary flow channel. In what follows, said connection between the secondary flow channel and the primary flow channel will also be denoted "pilot hole". In one embodiment, the pilot hole is arranged at a vena contracta of the primary flow channel. When fluid is flowing through the primary flow channel a fluid pressure at the outlet of the pilot hole will then be lower than the fluid pressure at the secondary inlet through the flow barrier, i.e. in the fluid upstream of the secondary inlet and thus the barrier.

The hydraulic resistance depends inter alia on a configuration of the pilot hole providing the connection between the secondary flow channel and the primary flow channel.

Preferably, a pressure drop through the secondary inlet is smaller than a pressure-drop through the pilot hole. Preferably, the pilot hole is designed so that a discharge coefficient (effective flow area divided by the physical flow area) is substantially independent of the Reynolds number.

The primary inlet may, in the position of use, be arranged at a first elevation, and the secondary inlet may be arranged at a second elevation that is different from the first elevation.

The valve may be an autonomous inflow control device, a so-called AICD, for controlling a fluid flow in, into or out of a production string of a well, the apparatus comprising:

a primary flow channel having a primary inlet through a flow barrier, and a low pressure portion;

a secondary flow channel connected to the primary flow channel, the secondary flow channel having a secondary inlet through the flow barrier, and a secondary outlet connected to the low pressure portion of the primary flow channel;

an outlet for fluid flowing into the passage; and a pressure controlled piston configured to move with respect to a stationary valve seat between an open position wherein the piston does not abut the valve seat and therefore allows fluid flow through the passage, and a closed position wherein the piston abuts the valve seat so that the passage is at least partially blocked;

wherein the primary inlet is arranged at a first elevation, and the secondary inlet in a position of use is arranged at a second elevation being different from the first elevation;

the apparatus further comprising an inflow control element responsive to a density of a fluid, the inflow control element being movable distant from the primary inlet between a first position wherein the inflow control element does not block the secondary inlet, and a second position wherein the inflow control element blocks the secondary inlet for inflow of unwanted fluid; and the pressure controlled valve is responsive to fluid pressure in the secondary flow path in such a way that the pressure controlled valve is moved to the closed position when the secondary inlet is blocked by the inflow control element.

For a petroleum well, the undesired fluid may typically be water or gas.

In an embodiment where the undesired fluid is water, the secondary inlet may, in the position of use, be arranged at a higher elevation than the primary inlet. In such an embodiment the inflow control device may have a density between the density of water and the density of oil.

In an embodiment where the undesired fluid is gas, the secondary inlet may, in the position of use, be arranged at a lower elevation than the primary inlet. In such an embodiment the inflow control device may have a density between the density of gas and the density of oil.

In an embodiment where the valve is configured for use in a WAG injection well (WAG—Water Alternating Gas), the secondary inlet may, in the position of use, be arranged at a lower elevation than the primary inlet. In such an embodiment the inflow control device may have a density between the density of water and a density of gas at an in situ condition. By in situ condition is meant reservoir pressure and temperature.

The inflow control element may be a float element movable in a path arranged at an upstream side of the flow barrier. The path may extend between the first position and the second position.

There are several advantages of providing such a path.

A first advantage is that the movement of the float element is kept within defined limits. This has the effect that the float element may be kept distant from the primary inlet for all flow regimes that may appear. The float element will thus not be subject to a "mix-phase" that may appear at the primary inlet in the fluid flow upstream of the barrier. Further, the float element will not provide an obstruction to the fluid flowing into the primary inlet.

A second advantage is that the secondary inlet may be arranged at a desired second elevation, and that the float element can be prevented from moving beyond the second elevation even if the fluid would otherwise move the float element beyond the secondary inlet.

The float element may be a ball movable in a path constituted by a guide element, such as for example a cage. The float element may typically be circular, but other shapes are also conceivable, such as non-circular, for example oblong, or disc-shaped, or polygonal.

In an alternative embodiment, the float element may be pivotably connected to an upstream portion of the barrier. In an embodiment where the float element is a disc, such a disc may be arranged in a disk-channel forming part of the barrier itself. Such a channel will then serve the same purpose as the path discussed above. The channel will be in constant fluid communication with the fluid flow upstream of the barrier so that the disc is exposed to the fluid flow upstream of the barrier.

Independent of the type of float element utilized, it must be capable of blocking the secondary inlet when the content of the undesired fluid in the fluid flow upstream of the barrier exceeds the predetermined level.

The piston may be axially movable within a portion of an annulus defined by:

- an inner tubular body being in fluid communication with the production string;
- a housing arranged coaxially with and surrounding a portion of the inner tubular body;
- a downstream barrier arranged within the annulus and axially spaced apart from the flow barrier;

wherein the annulus further comprises a stationary valve seat arranged between the downstream barrier and the flow barrier so that the piston abuts the valve seat when the valve is closed, and the piston does not abut the valve seat when the valve is open.

Such an axially movable piston may be movable with respect to a stationary valve seat typically arranged within in the valve chamber. Preferably, the primary flow channel is substantially a continuation of the flow upstream of the barrier.

The primary flow channel extends between the primary inlet and an outlet for providing fluid communication with a fluid flowing in the inner tubular body wherein the tubular body is in fluid communication with the production string as mentioned above. In what follows, the inner tubular body will also be denoted barrel.

In a basic configuration, the valve according to the invention has only two movable parts; the float element and the axially movable piston. This has the effect that the valve may be very reliable.

The valve seat may comprise a first valve seat element and a second valve seat element axially spaced apart from the first valve seat element. In such an embodiment, a portion of the piston may be movable between the valve seat elements. Said portion of the piston is operatively connected to the rest of the piston. When the valve is in the closed position the piston may abut both valve seat elements. This configuration with two valve seat elements is particularly useful for providing an added closing force to the valve and for providing a re-opening mechanism as will be discussed below.

To provide an added closing force, the valve may be provided with a pressure-controlled mechanism for providing a pressure differential across a portion of the piston when the piston abuts the stationary valve seat, the pressure-controlled mechanism may be responsive to a difference in fluid pressure upstream and downstream of the valve so that a closing force of the valve is added to the piston when said difference in fluid pressure is positive.

The pressure-controlled mechanism may comprise an annular cavity formed between a portion of the piston and the second valve seat element when said piston abuts a downstream face of the second valve seat element, and pressure communication channel passing through the second valve seat element for communicating fluid from the primary inlet to an annulus formed between the second valve seat element and the first valve seat element when the valve is closed.

The valve may be provided with a leakage means for allowing leakage through the valve when the valve is in a closed position.

In one embodiment, the leakage means may be an aperture extending through a portion of the second valve seat element, the aperture providing fluid communication through a portion of the piston and the first valve seat element. The purpose of such a leakage means is to provide a small leakage, typically in the range of 2-20% of a flow capacity of an open valve, through the valve so that an undesired fluid that caused the valve to initially close, is subsequently replaced by a desired fluid that may re-occur upstream of the barrier. Such a situation may occur if undesired fluid, for example water in a near-wellbore region, retreats and is replaced by desired fluid, such as oil. Thus, the leakage means may form part of a re-opening mechanism.

By the term "closing for fluid communication" as stated in the first aspect of the invention, is therefore meant restricting at least a major part of the fluid communication between a well and a production string.

In one embodiment, the fluid flow within the inner tubular body has to be temporarily stopped in order to re-open the secondary inlet in the barrier. In a petroleum well, fluid flow within the inner tubular body is stopped by stopping the production from the production string.

To facilitate re-opening of a closed valve, the valve may be provided with a biasing means configured for facilitating movement of the piston from a position wherein the valve is closed, to a position of the piston wherein the valve is open. The biasing means may be provided by at least one spring. Thus, the biasing means may be used to enforce a re-opening of a closed valve when fluid flow in the inner tubular body is temporarily stopped by stopping the production from the production string.

In some cases, it may be desired to provide a re-opening mechanism that is not dependent on stopping fluid flow within the inner tubular body, typically by stopping production of a petroleum well.

The pressure-controlled mechanism may further comprise a first leakage channel and a second leakage channel for communicating fluid upstream of the flow barrier to the pressure-controlled mechanism. The second leakage channel may be in fluid communication with a third inlet through the flow barrier, wherein the third inlet is arranged to be closed by means of the inflow control element when the content of undesired fluid in the fluid flow upstream of the flow barrier is below the predetermined level. Thus, the first leakage channel may provide a pressure differential across a portion of the piston when the piston abuts the stationary valve seat, and the pressure-controlled mechanism being responsive to a difference in fluid pressure upstream and downstream of the valve so that a closing force of the valve is added to the piston when said difference in fluid pressure is positive.

In a position of use, the first leakage channel may be arranged at an extreme level with respect to the primary inlet, the secondary inlet and the third inlet. For a valve configured for blocking inflow of water exceeding a predefined level in an oil producing well, the first leakage channel may be arranged at a higher level than the primary inlet, the secondary inlet and the third inlet. For such a configuration, the third inlet may be arranged between the level of the primary inlet and the secondary inlet. The effect of this is that when the valve is closed, the oil-water interface will be either at the first leakage channel or the second leakage channel being in fluid communication with the third inlet, depending on the water fraction and on a diameter ratio of the first leakage channel and the second leakage channel. For high water fractions, for example 80%, the interface will be at the first leakage channel, and for low water fractions, for example 20%, the interface will be at the third inlet that is in fluid communication with the second leakage channel.

For this embodiment, like the embodiment discussed above, the pressure-controlled mechanism may comprise an annular cavity formed between a portion of the piston and the second valve seat element when said piston abuts a downstream face of the second valve seat element. The pressure-controlled mechanism may further comprise a pressure communication channel passing through the second valve seat element for communicating fluid from the primary inlet to an annulus formed between the second valve seat element and the first valve seat element when the valve is closed.

The valve may comprise at least one secondary piston being axially movable with respect to the piston of the valve. In such an embodiment, the first leakage channel and the second leakage channel may be in fluid communication via a pressure communication channel influencing a position of the at least one secondary piston. The pressure communication channel may be in fluid communication with the third inlet of the barrier.

Thus, the secondary piston is configured to control a fluid communication and a pressure in the pressure-controlled mechanism and thus a position of the piston.

The first leakage channel and the second leakage channel may be merged or interconnected into one common channel prior to entering the pressure-controlled mechanism. A total leakage flow through a valve being in a closed position is thus controlled by the flow area of the common channel. Preferably, the flow area of the common channel is less than a sum of the flow area of the first leakage channel and the second leakage channel. The diameter ratio of the first leakage channel and the second leakage channel influences the fraction of the undesired fluid, for example water, at which the valve will re-open from a closed position.

Preferably, the valve is designed to re-open at a fraction of undesired fluid that is significantly lower than a fraction of undesired fluid where the valve closes. This has the effect of at least reducing possibility of the valve toggling between a closed position and an open position. By the term "significantly" is meant more than 5% difference.

The valve may further comprise a secondary inflow control element located in the fluid flow upstream of the flow barrier, and a further secondary inlet through the flow barrier and in fluid communication with the secondary flow channel. The further secondary inlet may be closable by the secondary inflow control element and arranged to open the further secondary inlet when the fluid upstream of the barrier comprises drilling fluid, and to close the further secondary inlet when the fluid upstream of the barrier does not comprise drilling fluid. The secondary inflow control element may have a density higher than the density of a desired fluid and the undesired fluid, but lower than the density of the drilling fluid. This has the effect that a drilling fluid that typically may exist in a well after the well has been drilled and completed, can be produced out of the well without being blocked or restricted by the valve.

The secondary inflow control element may be arranged in a similar manner as discussed above for the inflow control element for controlling inflow of fluid into the secondary inlet, i.e. movable for example in a path extending between a first position and a second position. Preferably, the path of the secondary inflow control element is different from the path of the inflow control element for the desired/undesired fluid.

Also described herein is a diverting device for controlling inflow of fluid to an inflow control device such as for example the valve according to the first aspect of the invention. The diverting device is arranged upstream of the inflow control device, such as the valve. The diverting device has an upstream end portion and a downstream end portion, and:

- a flow through conduit for allowing fluid communication from a flow through inlet at the upstream end portion, to the downstream end portion;
- a bypass conduit for allowing fluid communication from a bypass inlet at the upstream end portion, to an outlet arranged in fluid communication with an aperture in a wall of the production string, the outlet being arranged between the upstream end portion and the downstream end portion of the diverting device, the flow through inlet being spaced apart from the bypass inlet; and
- at least one diverting device inflow control element responsive to a density of a fluid;

wherein the diverting device inflow control element is located in the fluid flow at an upstream portion of the device and is arranged to block one of the flow through inlet and the bypass inlet depending on the density of the fluid at the upstream portion of the diverting device.

In a second aspect of the present invention there is provided a system for controlling inflow of a fluid from a well and into a tubular body forming part of a production string. The system may comprise at least one valve according to the first aspect of the invention. The system may further comprise:

- a diverting device arranged upstream of at least one of the at least one valve, wherein the diverting device has an upstream end portion and a downstream end portion, and:
- a flow through inlet in the upstream end portion;
- a flow through conduit for allowing fluid communication from a flow through inlet at the upstream end portion, to the downstream end portion;
- a flow through conduit for allowing fluid communication from the flow through inlet to the downstream end portion;
- a bypass inlet in the upstream end portion;
- a bypass conduit for allowing fluid communication from the bypass inlet to an outlet arranged in fluid communication with an aperture in a wall of the production string, the outlet being arranged between the upstream end portion and the downstream end portion of the diverting device, the flow through inlet being spaced apart from the bypass inlet; and
- at least one diverting device inflow control element responsive to a density of a fluid;

wherein the diverting device inflow control element is located in the fluid flow at an upstream portion of the device and is arranged to block one of the flow through inlet and the bypass inlet depending on the density of the fluid at the upstream portion of the diverting device.

The at least one diverting device inflow control element may comprise:

a diverting device first inflow control element arranged to block the flow through inlet when the fluid is drilling fluid;

a diverting device second inflow control element arranged to block the bypass inlet when the fluid is oil, water and/or gas;

wherein the first diverting device inflow control element is arranged in a first path, and the diverting device second inflow control element is arranged in a second path being separate from the first path.

In the position of use, the flow through inlet may be arranged at a higher elevation than the bypass inlet, and the diverting device inflow control element is one element movable in a path extending between a first position and a second position, wherein the inflow control element in the first position is configured to block the flow through inlet, and in the second position is configured to block the bypass inlet.

The diverting device inflow control element may have a density between that of drilling fluid and that of water. This has the effect that fluid is allowed through the flow through conduit and to the subsequent valve(s) when the diverting device is exposed to a fluid having a density being less than that of the inflow control element.

The diverting device may be provided with at least one leakage channel for allowing a leakage flow through the diverting device. This has the effect of continuously displacing "old" fluid with "new" fluid, such that the system can respond to changes in incoming fluid composition.

Hereinafter, the diverting device is also denoted a "cleanup module". The cleanup module may be arranged upstream of a valve configured for undesired fluid being water, hereinafter also denoted "water module", or a valve configured for undesired fluid in the form of gas, hereinafter also denoted "gas module". In one embodiment the cleanup module is arranged upstream of a water module and a gas module arranged in series with the water module.

In some wells, drilling fluid is displaced from the reservoir section prior to cleanup and before socalled "swell packers" have been expanded. A clean fluid, such as for example a base oil, is then pushed down a basepipe that may be in fluid communication with the inner tubular body disclosed herein, to TD (Total Depth) and back up in an annular space between a lower completion and a sandface. A person skilled in the art will appreciate that the sandface is the boundary between the well bore and the reservoir. The drilling fluid is then pushed up into a cased annulus. In order to ensure an efficient process whereby all the drilling fluid is displaced from the reservoir section, it is important to avoid backflow through the valves as this will represent short-circuits for the flow. Instead, temporary check valves can be installed in the cleanup module to prevent backflow and instead force the flow all the way to TD before returning in the annulus. The check valve can be made temporary by using a material that dissolves after some time of oil production. Thus, it may be advantageous if the cleanup module is provided with a check valve.

The system may be further provided with an ICD module (ICD—Inflow Control Device) on the downstream side of the valve(s). The purpose of the ICD module is to create a minimum pressure drop across the valve when the valve is open in order to enforce a more uniform inflow profile from the reservoir, which in turn may contribute to delayed gas and/or water breakthrough and therefore a more favourable reservoir drainage.

The ICD may be a single orifice with a small diameter, or it may comprise a plurality of parallel orifices with different sizes, where only one orifice is selected by configuring the ICD module manually prior to installation, or using a downhole prior art tool to rotate the ICD module to the desired position from the inside after installation. The ICD module might also have a permanent check valve that prevents reversed flow through the ICD, gas module and water module.

The system discussed above may also comprise a fail-safe mechanism, e.g. in the form of a sliding sleeve arranged inside the inner tubular body. Such a sliding sleeve may for example be pulled open from the inside by a well tool. The fail-safe mechanism may also be an integral part of the cleanup module or a separate module placed upstream of the cleanup module.

As will be discussed in more detail below, the present invention may also be utilized in WAG injection wells (WAG—Water Alternating Gas). In order to obtain a substantial uniform outflux profile along the reservoir section when gas is injected, it is desirable for some WAG injection wells to restrict the outflow of gas more than the outflow of water.

In a third aspect of the invention, there is provided a method for controlling fluid flow in, into or out of a well. The method may comprise the steps of:

mounting a valve according to the first aspect of the invention as part of a well completion string prior to inserting the string in the well;

bringing the well completion string into the well;

orienting the valve within the well; and flowing fluid in, into or out of the well.

The valve may for example be oriented by using an orientation means disclosed in Norwegian Patent application NO 20161700.

The method may further comprise:

arranging a diverting device upstream of at least one of the at least one valve, the diverting device having:

an upstream end portion and a downstream end portion;

a flow through inlet in the upstream end portion;

a flow through conduit for allowing fluid communication from the flow through inlet to the downstream end portion;

a bypass inlet in the upstream end portion;

a bypass conduit for allowing fluid communication from the bypass inlet to an outlet arranged in fluid communication with an aperture in a wall of the production string, the outlet being arranged between the upstream end portion and the downstream end portion of the diverting device, the flow through inlet being spaced apart from the bypass inlet; and at least one diverting device inflow control element responsive to a density of a fluid;

wherein the method comprises locating the diverting device inflow control element in the fluid flow at the upstream portion of the diverting device and arranging the inflow control element to block one of the flow through inlet and the bypass inlet depending on the density of the fluid at the upstream portion of the diverting device.

BRIEF DESCRIPTION OF THE FIGURES

In the following is described examples of preferred embodiments illustrated in the accompanying drawings, wherein.

DETAILED DESCRIPTION OF THE FIGURES

Figure 1:
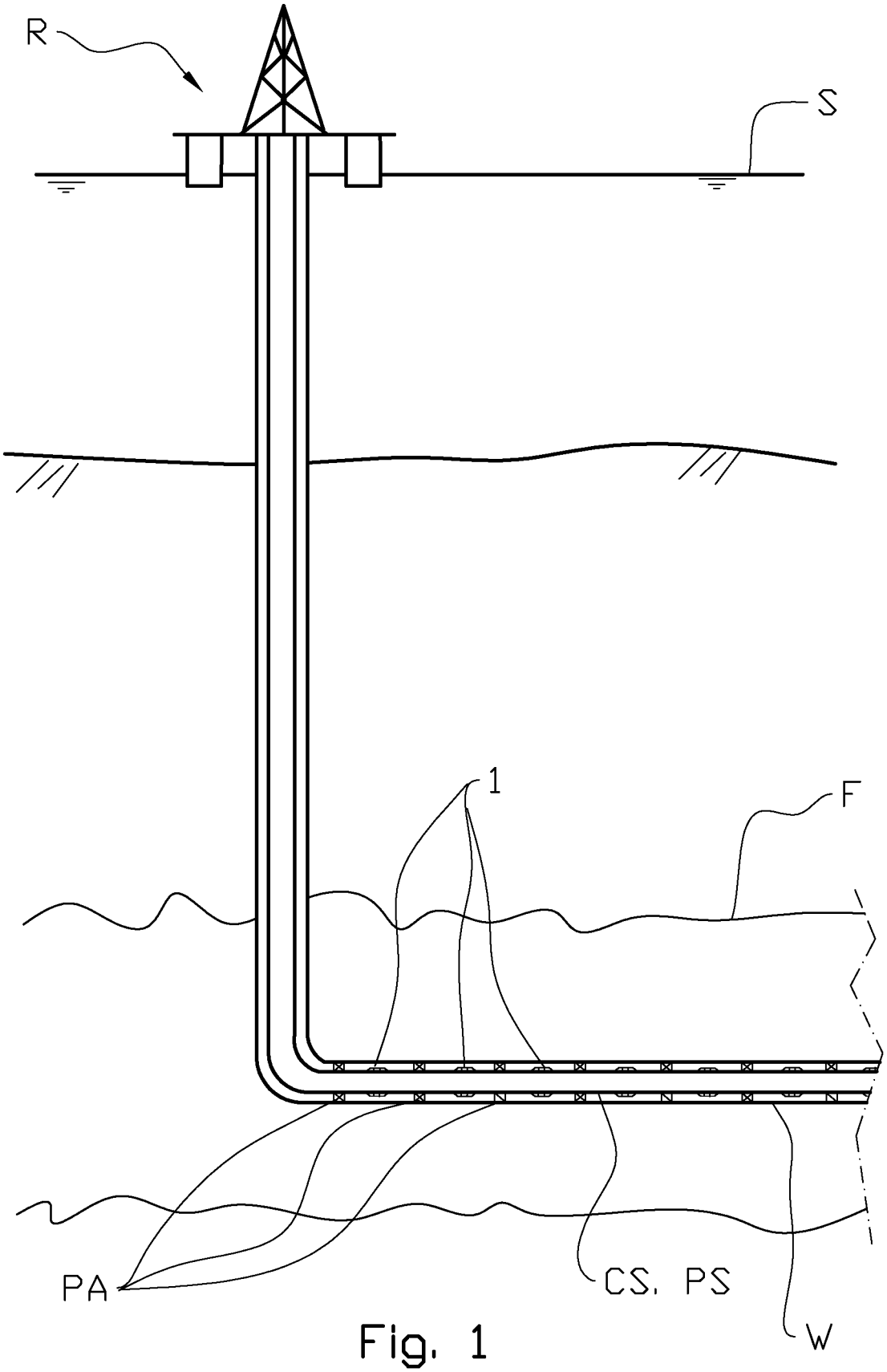
FIG. 1 shows a principle sketch of a typical subsea well having a plurality of valves according to the present invention distributed along a horizontal section of the well.

Positional indications such as for example "above", "below", "upper", "lower", "left", and "right", refer to the position shown in the figures.

In the figures, same or corresponding elements are indicated by same reference numerals. For clarity reasons some elements may in some of the figures be without reference numerals.

A person skilled in the art will understand that the figures are just principle drawings. The relative proportions of individual elements may also be strongly distorted.

In the figures, the reference numeral 1 denotes a valve according to the present invention.

FIG. 1 shows a typical use of the valve 1 in a well completion string CS arranged in a substantially horizontal wellbore or well W penetrating a reservoir F. The well W is in fluid communication with a rig R floating in a surface of a sea S. The well W comprises a plurality of zones separated by packers PA, for example so-called swell packers, as will be appreciated by a person skilled in the art. A person skilled in the art will understand that the well W may alternatively be an onshore well.

Figure 2:
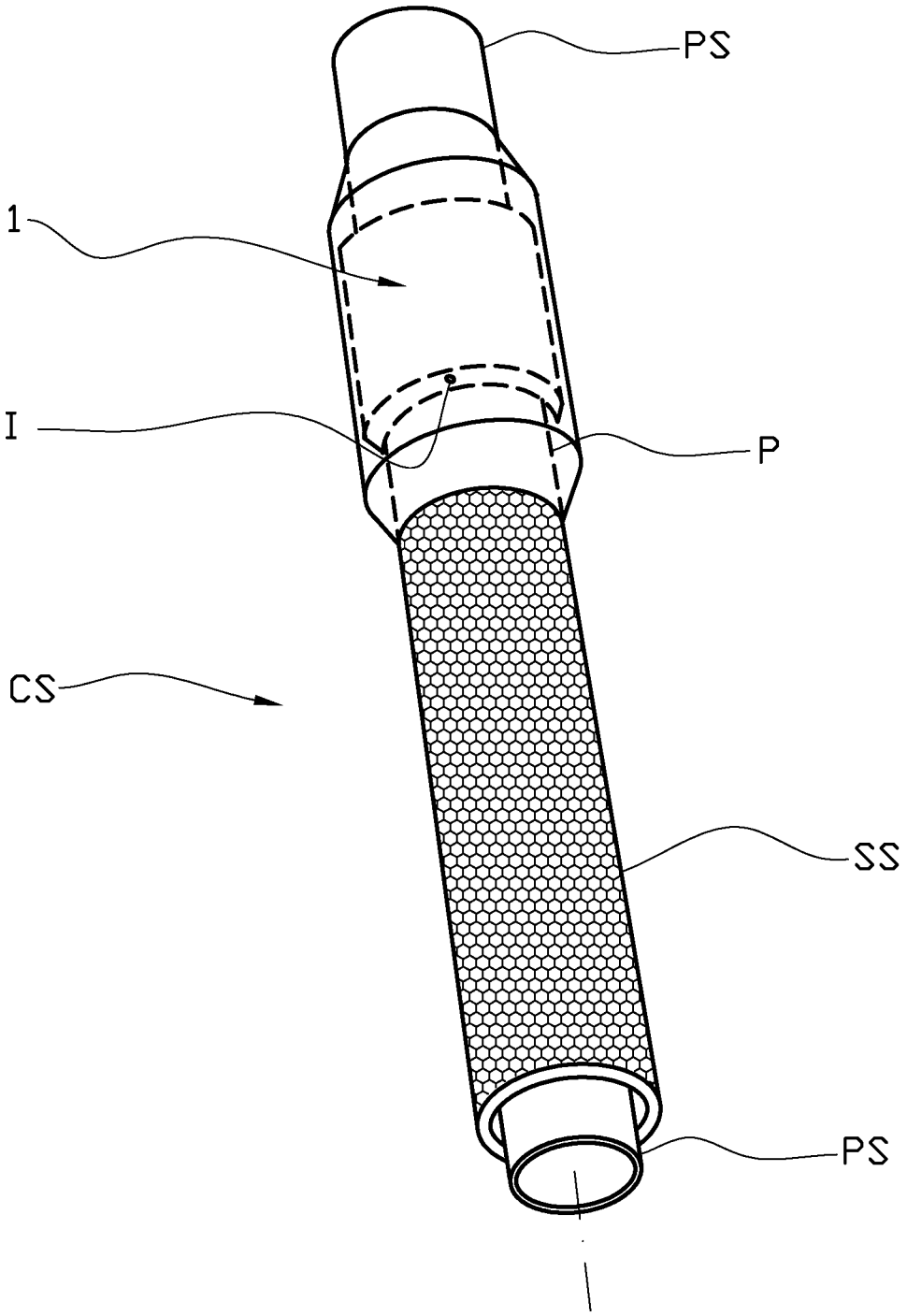
FIG. 2 shows in larger scale a perspective view of a pipe stand comprising a base pipe and a screen, and an apparatus according to the present invention.

In FIG. 1, one valve 1 is shown for between pairs of packers PA. However, it should be clear that two or more valves 1 will typically be arranged between each pair of packers PA FIG. 2 shows a typical arrangement of the valve 1 in a portion of a well completion string CS. The valve 1 is positioned between a basepipe P and a sandscreen SS. In FIG. 2, the valve 1 according to the invention is indicated with broken lines. An inflow portion of the valve 1 is denoted I.

The valve 1 may form part of a so-called pipe stand that may have a typical length of approximately 12 meters, for example. However, the valve 1 may also be arranged in a separate pipe unit having for example a length of only 40-50 centimeters. Such a unit may be configured to be inserted between two subsequent pipe stands.

The valve 1 according to the invention is orientation dependent. In the figures, this is indicated by a g-vector.

In order to explain a basic principle of the valve 1 according to the invention, reference is first made to FIGS. 3*a*-3*f*. It should be emphasized that the primary purpose of FIGS. 3*a*-3*f* is to explain how a position of an axially movable piston is activated when an undesired fluid, here in the form of water, exceeds a predetermined level. It should also be noted that required elements of the valve, such as a valve seat, has been left out. However, a more detailed description of embodiments of the valve 1 are disclosed in FIGS. 4*a* et seq.

In FIGS. 3*a*-3*f*, the valve 1 comprises a primary flow channel 3 having a primary inlet 5 through a flow barrier 7. The primary flow channel 3 is configured for influencing a pressure of the fluid through the channel 3. In the embodiment shown, the primary flow channel comprises a venturi with a vena contracta portion 5' for providing a low pressure portion.

The valve 1 further comprises a secondary flow channel 9 having a secondary inlet 11 in the flow barrier 7, and a pilot hole in the form of a secondary outlet 13 in fluid communication with the vena contracta portion 5', i.e. the low pressure portion of the primary flow channel 3.

A chamber 17 is arranged between the secondary inlet 11 and the secondary outlet 13 of the secondary flow channel 9. Thus, the chamber 17 forms part of the secondary flow channel 9.

Although not specifically shown in FIGS. 3*a*-3*f* it should be clear that a hydraulic resistance of the secondary outlet 13 or the pilot hole is larger than the hydraulic resistance of the secondary inlet 11.

The secondary outlet 13 is provided with a funnel-shaped inlet portion. Such an inlet portion is favourable as the effective flow area then becomes substantially the same as the smallest cross-section of the secondary outlet 13. A discharge coefficient of the secondary outlet 13 (the pilot hole) will then be close to one, thereby removing its sensitivity to Reynolds number.

An axially movable piston 20 has a first piston portion 22 exposed to the fluid in the chamber 17, and a second piston portion 24 exposed to a fluid in the primary flow channel 3 downstream of the venturi. In this way, an axial position of the piston 20 is influenced by any pressure differential across the piston 20. The piston 20 is operatively connected to a valve seat (not shown) so that the primary flow channel 3 can be closed.

The valve 1 further comprises an inflow control element 30 responsive to a density of an undesired fluid, here in the form of water. The inflow control element 30 is located in the fluid flow upstream of the barrier 7 and is arranged to close the secondary inlet 11 when the content of the undesired fluid in the flow upstream of the barrier 7 exceeds a predetermined level. The inflow control element 30 is, in the embodiment shown, movable in a path 32 constituted by a cage-like arrangement, between a first position wherein the inflow control element 30 does not block the secondary inlet 11, and a second position wherein the inflow control element 30 does block the secondary inlet 11.

Both in the first position and the second position the inflow control element 30 is located distant from the primary inlet 5 of the primary flow channel 3. Thus, the inflow control element 30 will not be subject to a stratified flow that may occur at the primary inlet 5, and the inflow control element 30 will not "disturb" or provide an obstruction to the fluid flowing into the primary flow channel 3.

Figure 3A:
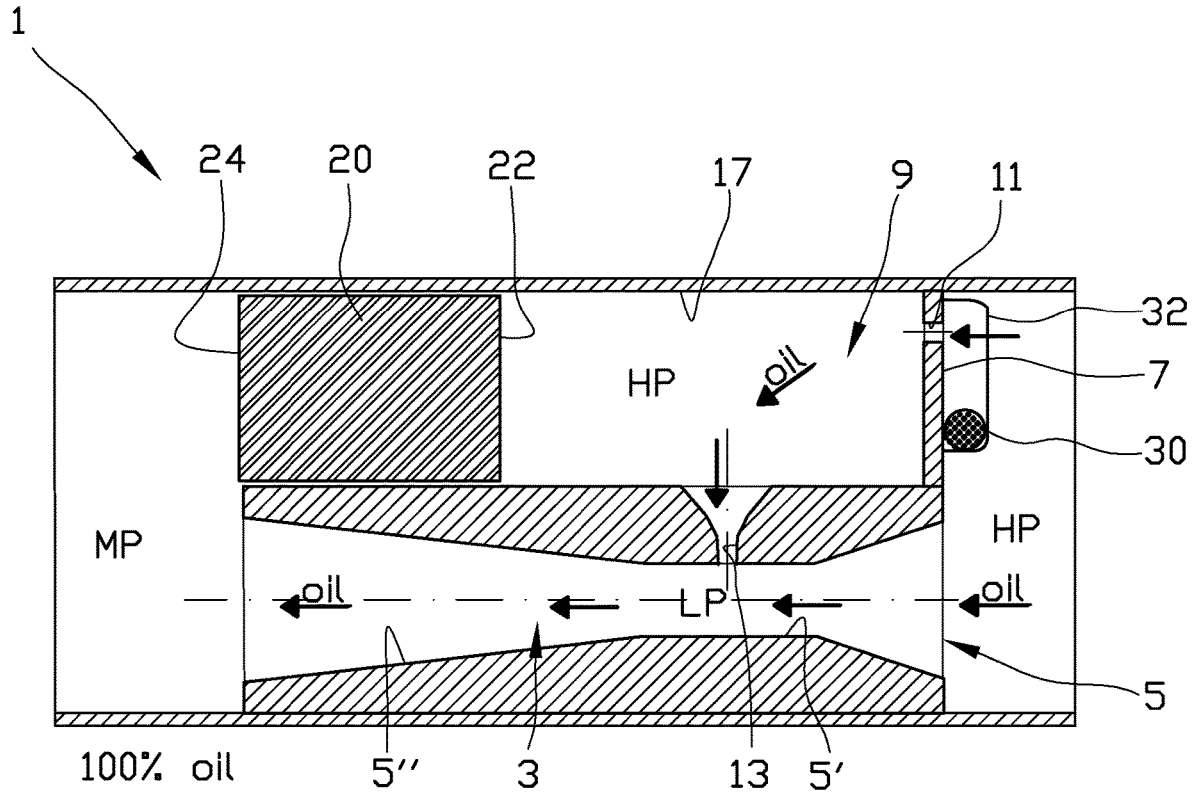
FIG. 3*a*-3*f* illustrate an important operation principle of the valve according the invention.

In FIG. 3*a*, oil only is drained from for example the reservoir F as shown in FIG. 1. Oil is therefore flowing into the primary flow channel 3 via the primary inlet 5 and into the secondary flow channel 9 via the secondary inlet 11 which is open, i.e. not blocked by the inflow control element 30 which in the embodiment shown has a density between that of oil and that of water.

Upstream of the barrier 7 there is a fluid having a high pressure HP. In the vena contracta portion 5' of the primary flow channel 3, there will be a low pressure LP. In a producing well being in fluid communication with a downstream portion of the primary flow channel 3, a partial pressure recovery will exist downstream of the venturi that comprises the vena contracta portion 5'. The partial pressure recovery will result in a medium fluid pressure MP downstream of the venturi. Due to the hydraulic resistance of the secondary outlet 13 being larger than the hydraulic resistance of the secondary inlet 11, a high pressure HP will exist also in the chamber 17 forming part of the secondary flow channel 9. Thus, there will be a pressure difference between the piston surfaces 22, 24 which urges the piston 20 to the left. In this position, the piston 20 does not close the primary flow channel 3 as will be explained in more details from FIGS. 4*a* et seq.

The terms high pressure, medium pressure and low pressure denote mutual relative fluid pressures upstream of and within the valve 1.

In an oil producing well W, a person skilled in the art will appreciate that the well is likely to produce also water.

Figure 3B:
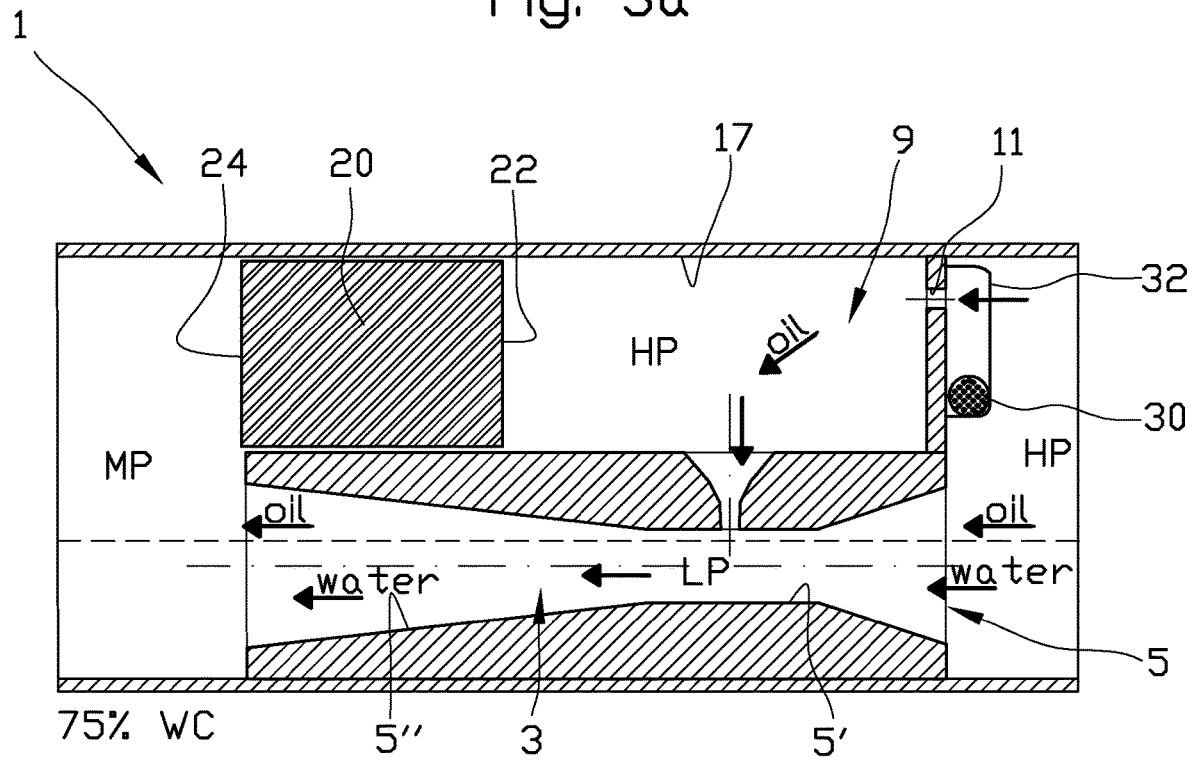

In FIG. 3*b*, a so-called water-cut WC has risen to about 75%. In FIG. 3*b*, the valve 1 is configured to close with a water cut higher that 75%. Thus, a mixture of all the water and a portion of the oil is flowing through the primary flow channel 3 as indicated, while oil is flowing through the secondary flow channel 9. Since all the water is flowing through the primary flow channel 3, the inflow control element 30 is still in the first, non-blocking position.

The pressure regime in the situation shown in FIG. 3*b* is similar to that discussed with regards to FIG. 3*a*. Thus, the valve 1 is open.

Figure 3C:
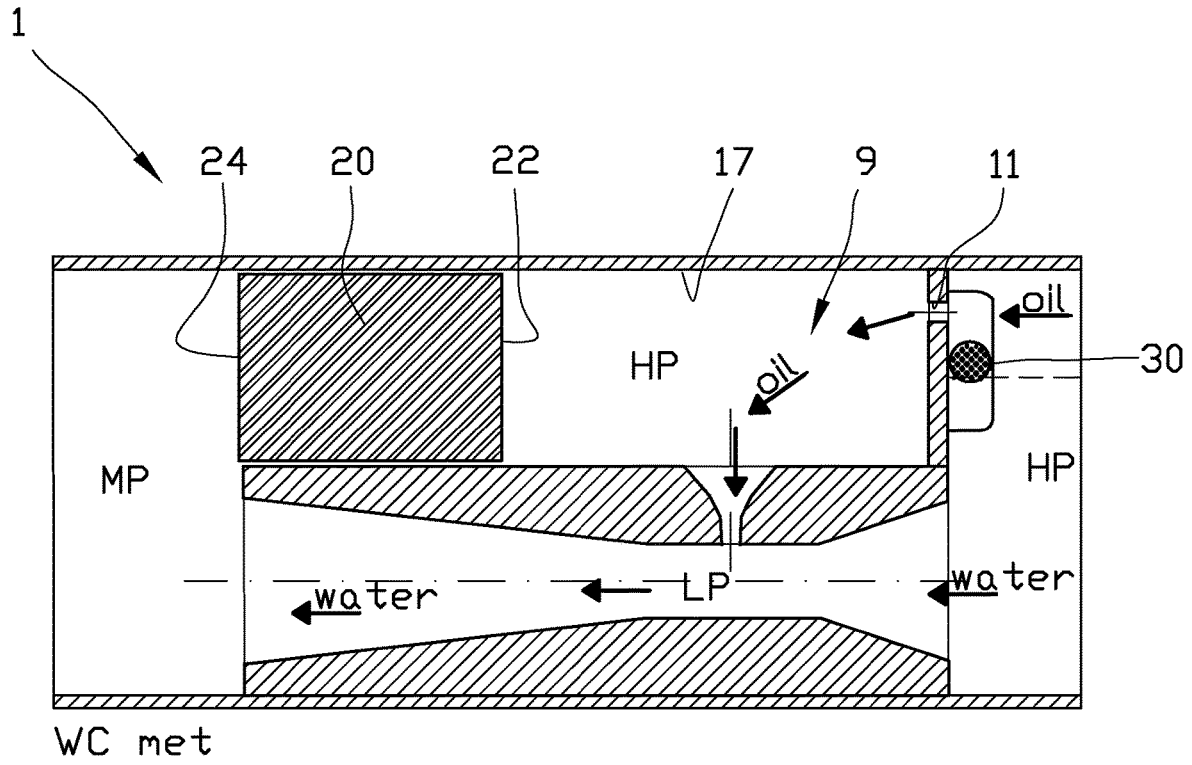

FIG. 3*c* shows a situation wherein the inflow of water has just passed a predetermined level. The predetermined level may for example be a water content of 90%. In this situation, all the water flow upstream of the valve 1 is larger than a flow through the primary channel 3. Thus, the water will ascend very quickly, typically within a few seconds, and bring the inflow control element 30 upwards. The inflow control element 30 will therefore move from the first position to the second position where it blocks the secondary inlet 11.

The pressure regime in the situation shown in FIG. 3*c* is similar to that discussed with regards to FIG. 3*a*. Thus, the valve 1 is open.

Figure 3D:
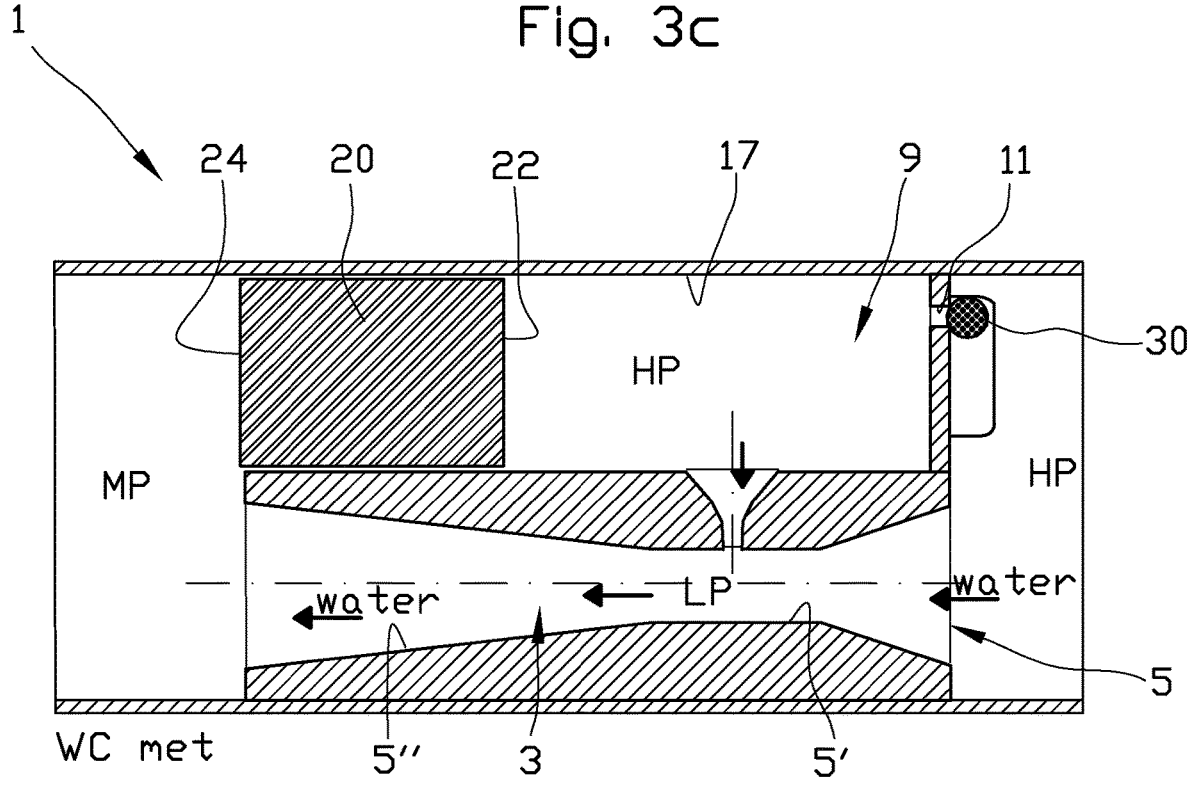
Figure 3E:
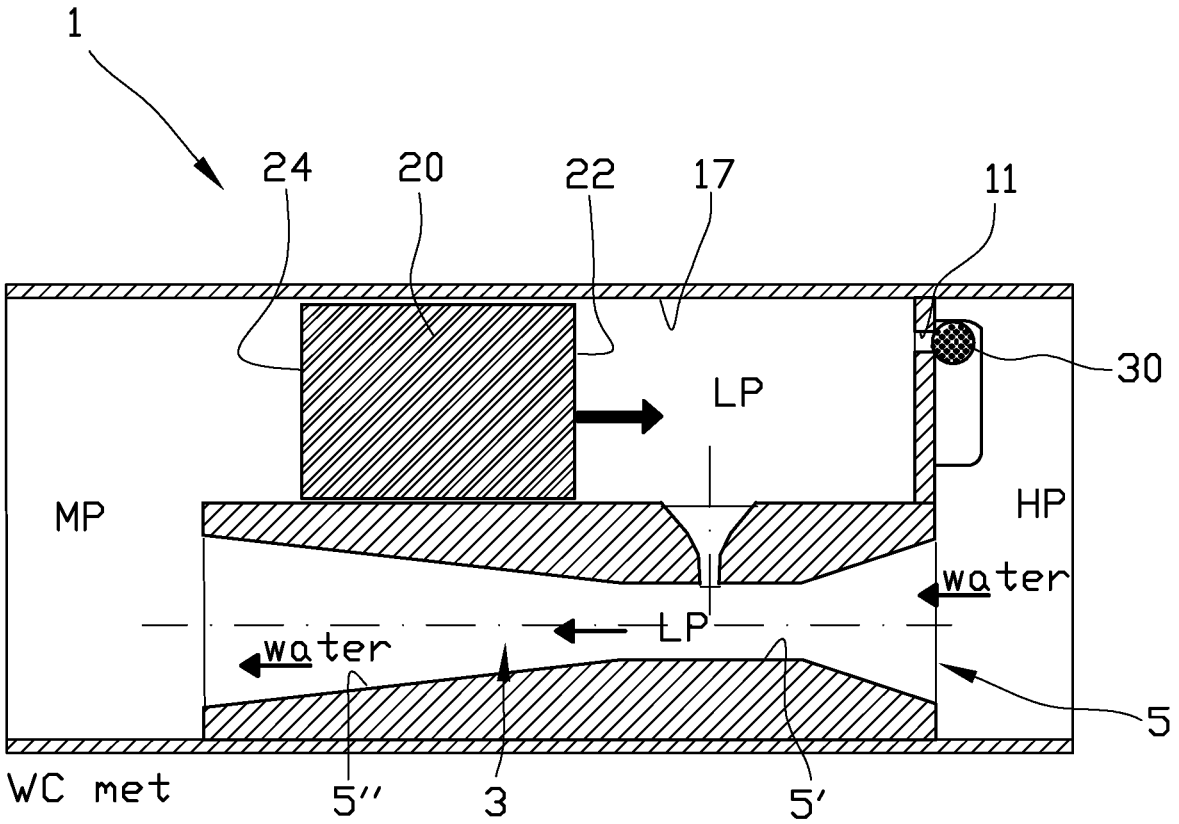

In FIG. 3*d*, the inflow control element 30 has just reached the second position and blocks the secondary inlet 11. The pressure within the chamber 17 will quickly (instantaneously) be reduced from the high pressure HP to a low pressure LP shown in FIG. 3*e*. Due to the medium pressure MP in the portion of the primary flow channel 3 being downstream of the venturi and the second piston portion 24, the piston 20 will be axially displaced in an upstream direction, i.e. towards the right as indicated by the arrow at the first piston portion 22, and close the valve 1. Again, further features of the valve 1 causing closing of the valve 1 will be explained below.

Figure 3F:
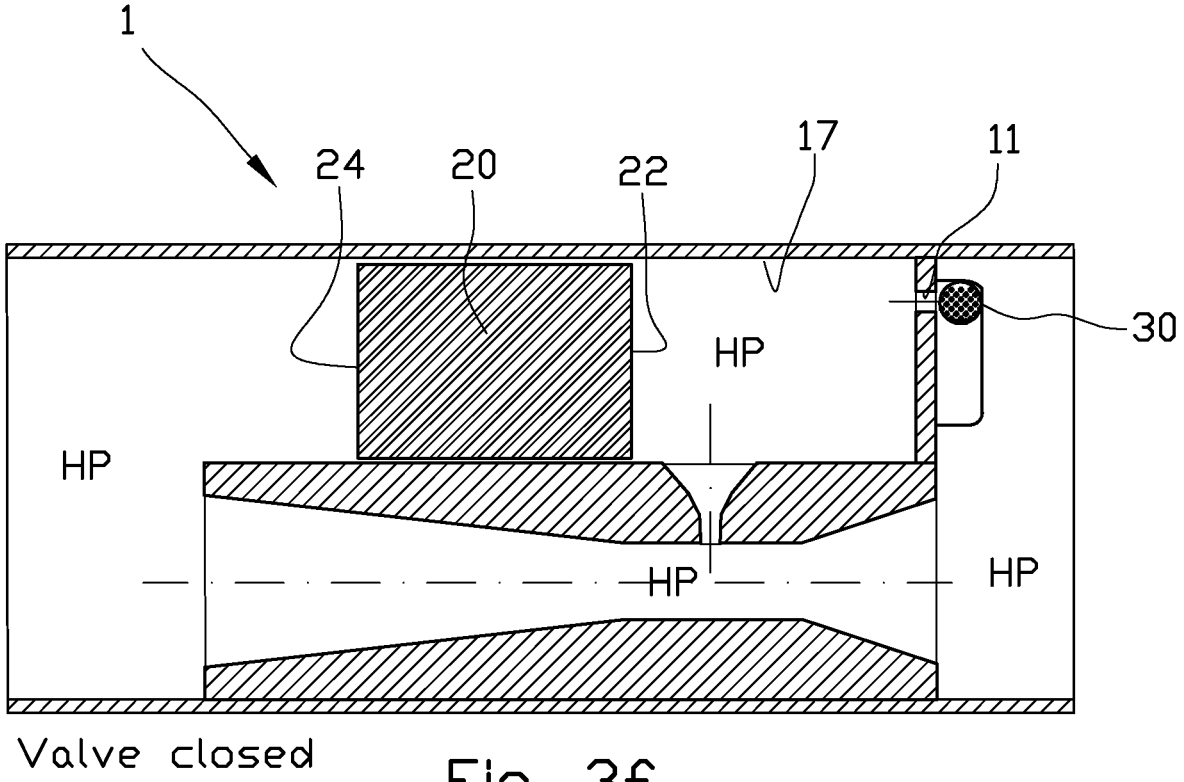

When the valve 1 has been closed, as shown in FIG. 3*f*, the pressure regime within the valve will be equalized with the pressure upstream of the valve 1, including the pressure across the inflow control element 30.

The above should explain the basic feature of the valve 1 according to the present invention.

In what follows, the invention will be explained in more details.

FIGS. 4*a*-4*f* show an example of a basic configuration of a valve 1 according to the present invention. The valve 1 comprises similar elements as discussed above with regards to FIGS. 3*a*-3*f*. Elements discussed in FIGS. 3*a*-3*f* will therefore be denoted in definite form in what follows.

The valve 1 is designed for closing inflow of a fluid from the well W shown in FIG. 1. The valve 1 may typically be arranged as shown in principle in FIG. 2. In the embodiment shown in FIG. 4*a*, the valve is in an open position and configured for blocking inflow of an undesired fluid in the form of water exceeding a predetermined level.

The valve 1 is arranged in an annular space defined between an inner barrel P, such as for example a basepipe that may form part of or be connected to a production string PS of a petroleum well W, an outer housing H enclosing a portion of the inner barrel P, an upstream barrier 7 and a downstream barrier 7'.

The barrel P is provided with an aperture 35 for allowing fluid communication between the primary flow channel 3 and the production string. The aperture 35 is arranged downstream of the second piston portion 24.

The valve 1 shown in FIGS. 4*a*-4*f* comprises a hollow, annular piston 20 axially movable in a portion of the annular space, between a first position and a second position.

The second piston portion 24 is provided with an opening 24' forming part of the primary flow channel 3.

The valve 1 is further provided with a valve seat 40 in the form of an annular wall 40 protruding from an inner surface of the housing H. The valve seat 40 is arranged within a hollow portion 25 of the piston 20 so that the second piston portion 24 of the piston 20 does not abut the wall 40 when the piston 20 is in the first position, but abuts the wall 40 when the piston 20 is in the second position. The opening 24' in the second piston portion 24 is blocked by the wall 40 when the piston 20 is in the second position. In what follows, the piston portion 24 will also be denoted piston surface 24. Fluid flow through the primary flow channel 3 is prevented when the opening 24' is blocked. The valve 1 is closed when there is no flow through the primary flow channel 3.

Figure 4A:
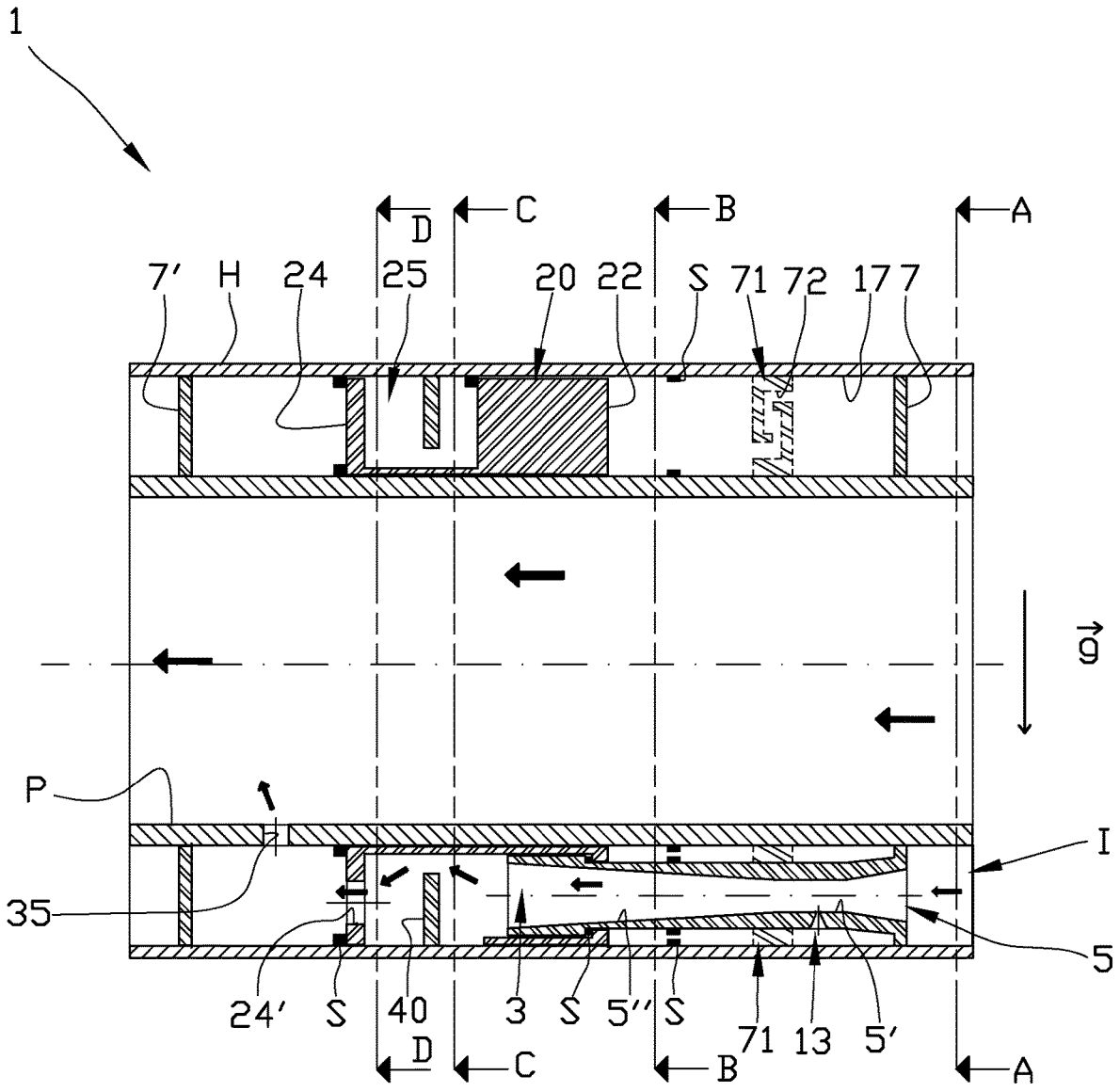
FIG. 4*a* shows an axial cross-section through the valve in an open position, the valve being configured for blocking inflow of water exceeding a predetermined level.

As best seen in FIG. 4*a*, the chamber 17 which forms part of the secondary flow channel 9, and a portion of the piston 20 encloses an axial portion of the venturi portion of the primary flow channel 3. The venturi portion of the primary flow channel 3 comprises the primary inlet 5, the vena contracta 5', and an expansion or diffuser section 5". The primary inlet 5 is arranged in a lower portion of the flow barrier 7 facing an inlet I of the valve 1.

The piston 20 encloses a portion of the expansion section 5" of the venturi portion of the primary flow channel 3.

In FIG. 4*a* various stopping mechanisms and seals S are configured for defining end positions for the axial movements of the piston 20, and for preventing leakage around the piston 20 and venturi whenever the piston 20 is in fully open or fully closed position, which will be the case during a majority of the operational lifetime of the valve 1. In order to avoid excessive leakage around the piston 20 and/or venturi, which might jeopardize the reliability of the valve, small clearances and/or slide bearings are preferably utilized.

Figure 4B:
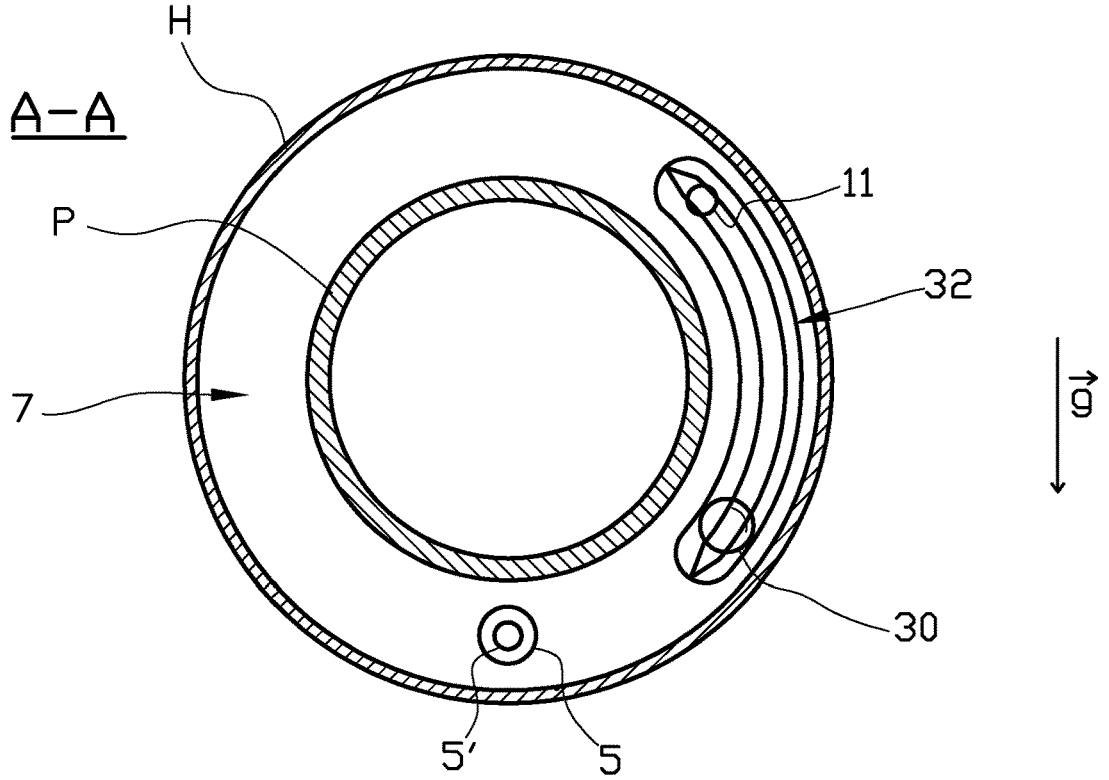
FIG. 4*b* shows a cross-section through A-A of FIG. 4*a* when an inflow control element does not block a secondary inlet of a secondary flow channel.

In FIG. 4*b* the valve 1 is seen from right to left in FIG. 4*a* and shows that the secondary inlet 11 of the secondary flow channel 9 is arranged at a higher elevation than the primary inlet 5 of the primary flow channel 3.

The inflow control element 30 is in the form of a ball 30 which in the embodiment shown in FIG. 4*a*-4*f*, has a density between that of oil and water.

FIG. 4*a* and FIG. 4*b* show a situation wherein the fluid flow upstream of the valve 1 corresponds to that discussed above in relation to FIGS. 3*a*-3*b*. Thus, when oil flows through the valve 1, the inflow control element 30, here the ball 30, will reside at the bottom of the path 32. The path 32 will hereinafter also be denoted cage 32. When the ball 30 resides at the bottom of the cage 32, the secondary inlet 11 of the secondary flow path 9 is open to flow. Thus, the fraction of the total flow rate that flows in the secondary flow path 9 is determined by the diameter of the vena contracta 5' and the pilot hole or secondary outlet 13 that is in fluid communication with the vena contracta 5'. As indicated in FIG. 4*a* showing the secondary outlet 13 and for example FIG. 4*b* showing the secondary inlet 11, a diameter of the secondary inlet 11 is much larger than the diameter of the secondary outlet 13 such that a hydraulic resistance of the secondary outlet 13 is larger than the hydraulic resistance of the secondary inlet 11. In one embodiment, the hydraulic resistance of the secondary outlet 13 is about 200 times larger than the hydraulic resistance of the secondary inlet 11. Thus, most of the pressure drop along the secondary flow path 9 takes place across the secondary outlet 13. As a result, the pressure acting on the first piston surface 22 facing the chamber 17 is substantially the same as the inlet pressure of the valve 1.

When the water fraction is low or moderate, for example in the range of 0%-80%, the oil-water interface level of the incoming stratified flow will be located at the primary inlet 5 of the primary flow channel 3. This means that all the water will follow a flow path through the venturi, whereas the oil flow will be split between the primary inlet 5 of the primary flow channel 3 and the secondary inlet 11 of the secondary flow channel 9.

Figure 4C:
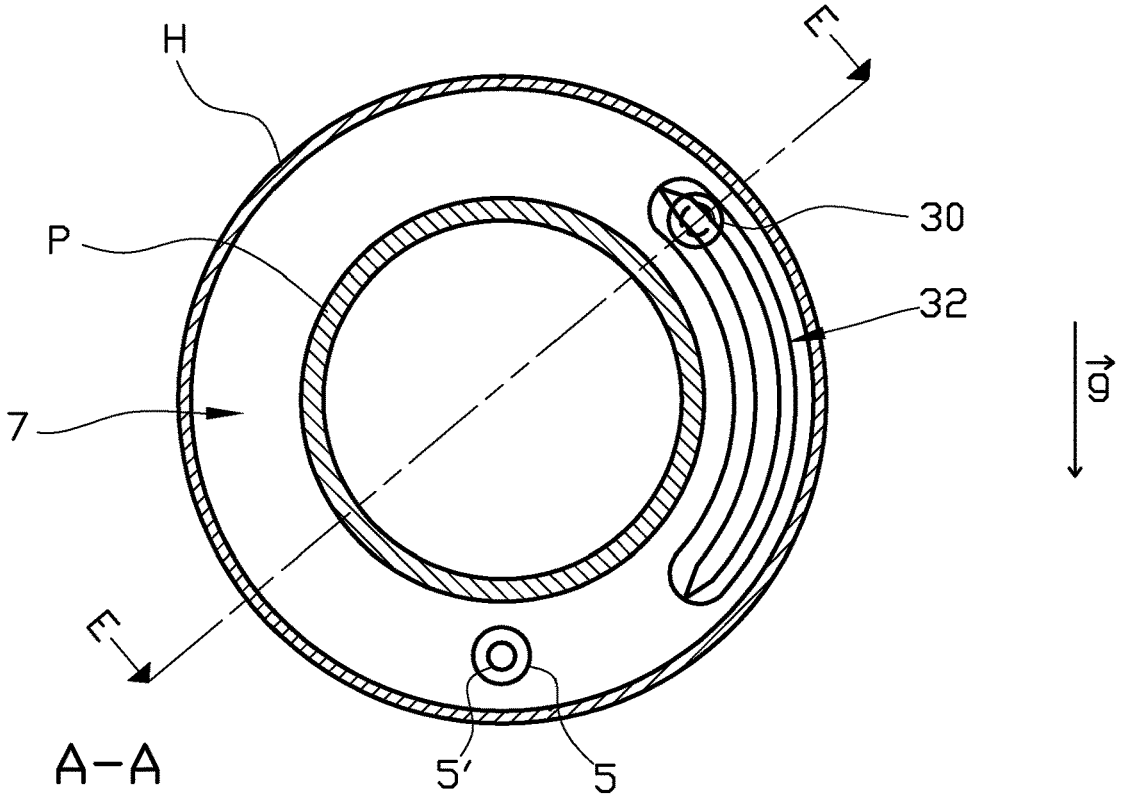
FIG. 4*c* shows a cross-section through A-A of FIG. 4*a* when an inflow control element does block a secondary inlet of a secondary flow channel.
Figure 5A:
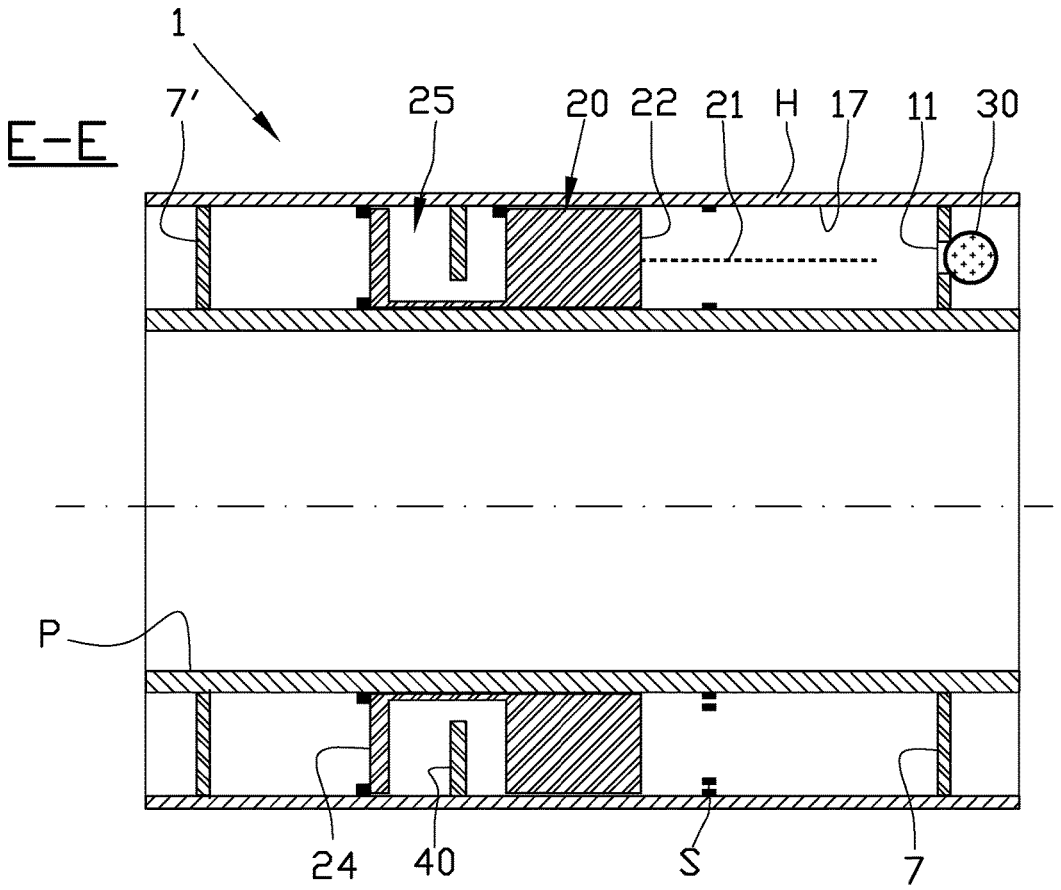
FIG. 5*a* shows in larger scale an axial cross-section through E-E of FIG. 4*c;*

As the water fraction increases, for example above 80%, a point will be reached where the flow rate of the water fraction exceeds a flow capacity of the venturi. The oil-water interface level will then ascend from the primary inlet 5 to the secondary inlet 11. As the inflow control element 30, here in the form of a ball 30, is free to move within the cage 32, it will follow the oil-water interface upward and eventually block the secondary inlet 11, as illustrated in FIGS. 4*c* and 5*a*. Once this situation occurs, the pressure within the chamber 17 and thus against the first piston surface 22, will be quickly reduced from a pressure being higher than the pressure against the second piston surface 24, to a pressure against the first piston surface 22 being lower than the pressure against the second piston surface 24. Thus, the piston 20 will move from the position shown in FIGS. 4*a* and 5*a*, via an intermediate position shown in FIG. 5*b* to a position shown in FIG. 5*c* wherein the piston 20 has moved to the second position (to the right) and thereby closed valve 1. When the valve 1 has been closed, the pressure regime in all parts of the valve 1 will be equalized with the pressure upstream of the valve 1, including the pressure across the inflow control element 30.

In FIG. 5*a*, the valve 1 is provided with an optional rod 21 (indicated by dotted lines) protruding from the first piston surface 22 towards a portion, for example a centre portion, of the secondary inlet 11. The purpose of the rod 21 is to push the inflow control element 30, here the ball 30, away from secondary inlet 11. As the piston 20 moves from an open position, as shown in FIG. 5*a*, to closed position, see FIG. 5*c*, the rod 21 will approach the ball 30. Right before the piston 20 reaches its closed position and the sealings S start to be activated, an end portion of the rod 21 moves through a portion of the secondary inlet 11 and abuts against the ball 30 which is then urged away from the periphery of the secondary inlet 11. The optional rod 21 represents a mechanical supplement or an alternative to a pressure equalization mechanism that will be discussed below. It should be noted that if the valve 1 is provided with the annular wall 71 indicated in FIG. 4*a*, such an annular wall 71 must be provided with an aperture (not shown) for allowing axial movement of the optional rod 21.

With the secondary inlet 11 blocked by the ball 30, all the flow is forced through the venturi, which means that the oil-water interface level will for continuity reasons be forced back down to the venturi. The ball 30, however, will still remain at the secondary inlet 11 because of the low pressure within the chamber 17 and a high pressure at the inlet I.

Figure 4D:
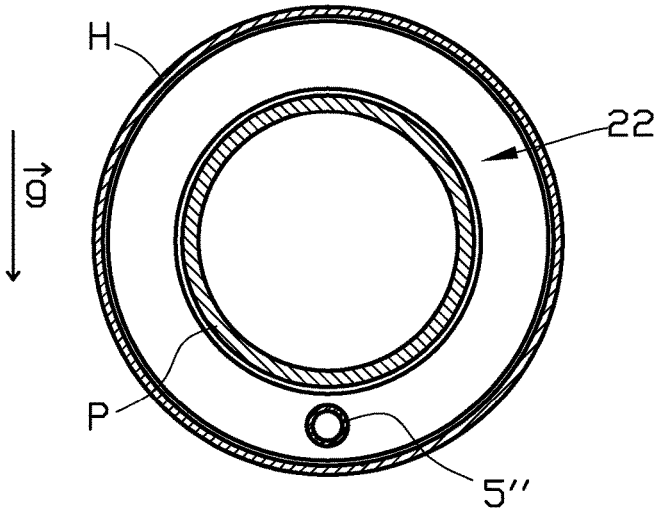
FIG. 4*d* shows in smaller scale a cross-section through B-B of FIG. 4*a;*
Figure 4G:
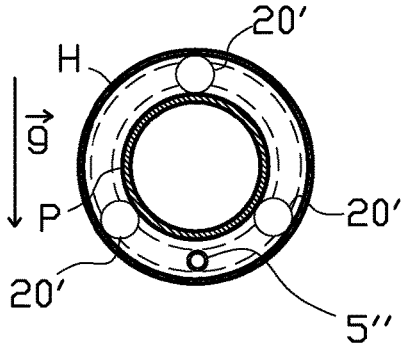
FIG. 4*g* shows in smaller scale a principle sketch of an alternative embodiment of FIG. 4*d;*
Figure 4E:
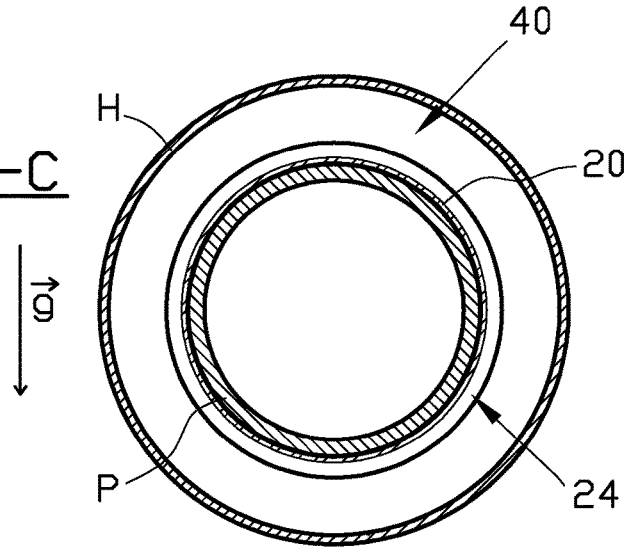
FIG. 4*e* shows in smaller scale a cross-section through C-C of FIG. 4*a;*
Figure 4F:
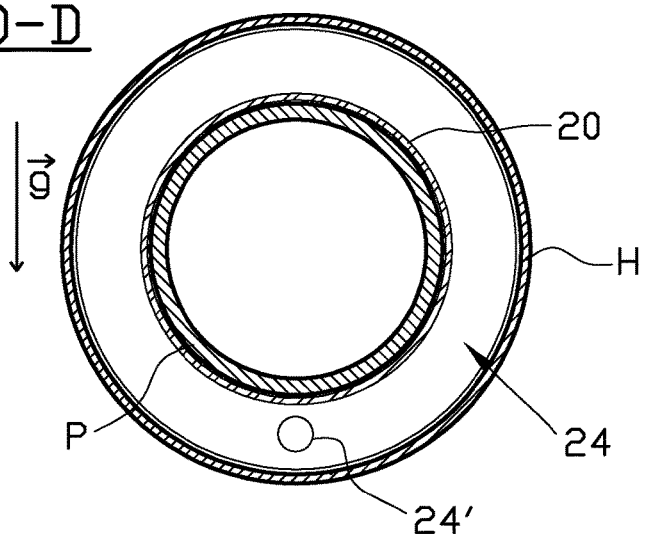
FIG. 4*f* shows in smaller scale a cross-section through D-D of FIG. 4*a;*

During normal production of reservoir fluids through the valve 1, there is a risk that particles and fines may settle in the vicinity of the piston 20. By vicinity is meant upstream of and in the narrow annular spaces defined by the piston 20 and the barrel P and housing H. Settled particles and fines may restrict or even prevent the piston from moving. This risk that the piston 20 being restricted or prevented from moving may be reduced by providing a fixed wall 71 on an upstream side of the piston 20. Such wall 71, indicated by dotted lines in FIG. 4*a*, should extend radially from the outer surface of the inner barrel P to the inner surface of the housing H. The wall 71 shown in FIG. 4*a* will protect the piston 20 from the surrounding flow and particles. The wall 71 is provided with a tortuous channel 72 running through the wall 71. The tortuous channel 72 ensures pressure communication, but no flow, except when the piston 20 is moving and fluid needs to be communicated through the walls. The content (amount) of fines and particles associated with this fluid communication is negligible. A similar principle may be used for reducing a risk that particles and fines may settle in the vicinity of a downstream side or the piston 20. FIGS. 4*d*-4*f* show various cuts through the valve shown in FIG. 4*a*.

The limiting water fraction above which the valve closes, depends on the diameter ratio of the secondary outlet 13 and vena contracta 5'. If it is preferred that the valve 1 closes at a high water cut, for example above 80%, the secondary outlet 13 should have a small diameter, such as for example 1 mm. If a small diameter represents an unacceptable risk of particle blockage, the secondary outlet 13 can alternatively be replaced by a long circular tube with the smallest acceptable diameter. By making the tube sufficiently long, for example by winding it helically around the barrel P, the limiting water fraction can become very close to 100%.

The valve 1 shown in FIGS. 4*a*-4*f* may also be configured for use in gas fields where the production facilities, for example a rig, has a limited capacity for handling liquid. By providing an inflow control element 30 having a density between that of gas and oil instead of a density between water and oil as discussed above, the valve 1 can be used to block or restrict both water and oil (condensate).

Figure 6A:
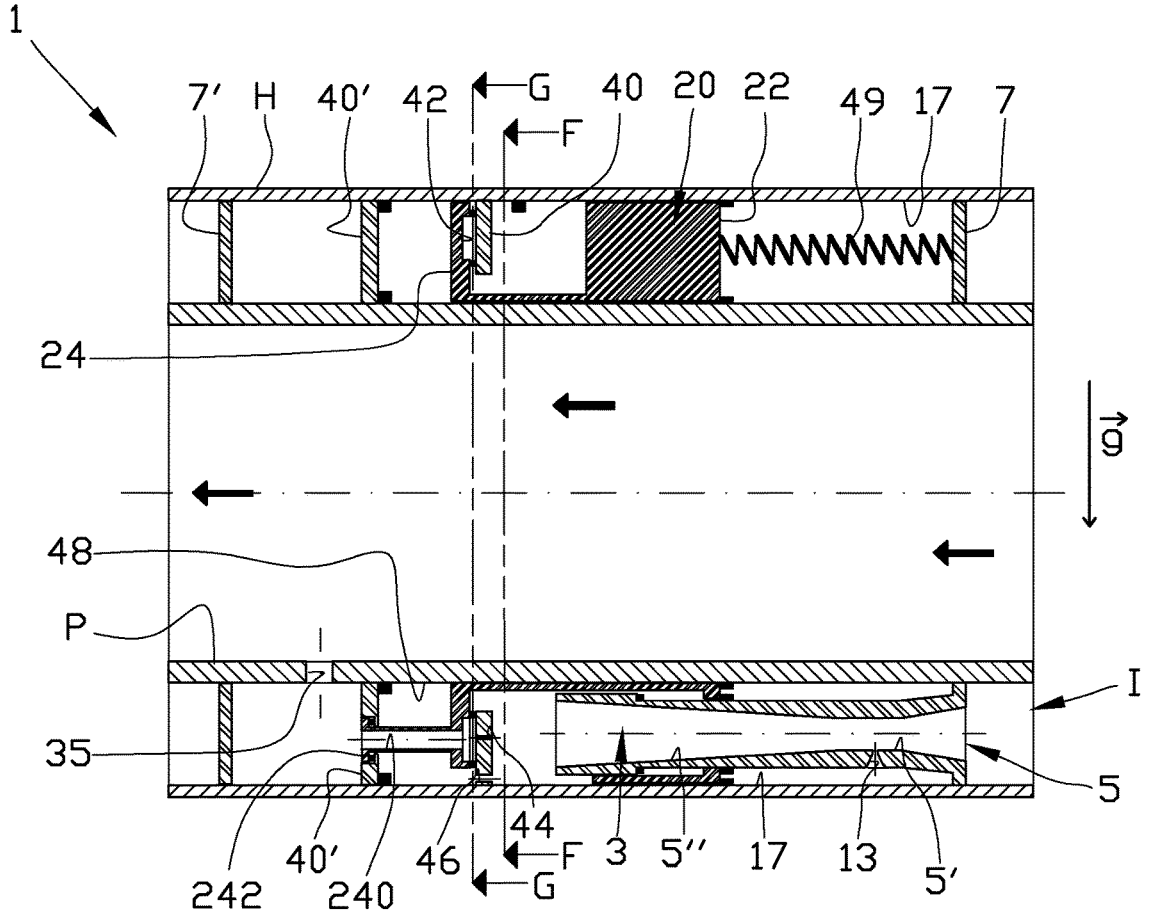
FIG. 6*a* shows an alternative embodiment of the valve shown in FIG. 4*a*, wherein the valve is further provided with a re-opening mechanism.
Figure 6B:
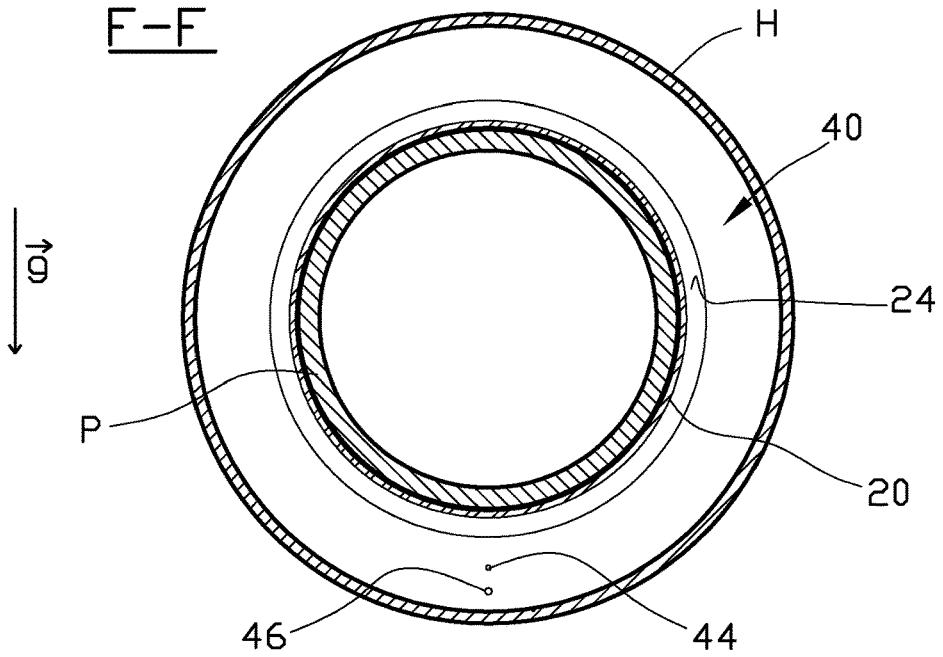
FIG. 6*b* shows a cross-section through F-F of FIG. 6*a;*
Figure 6C:
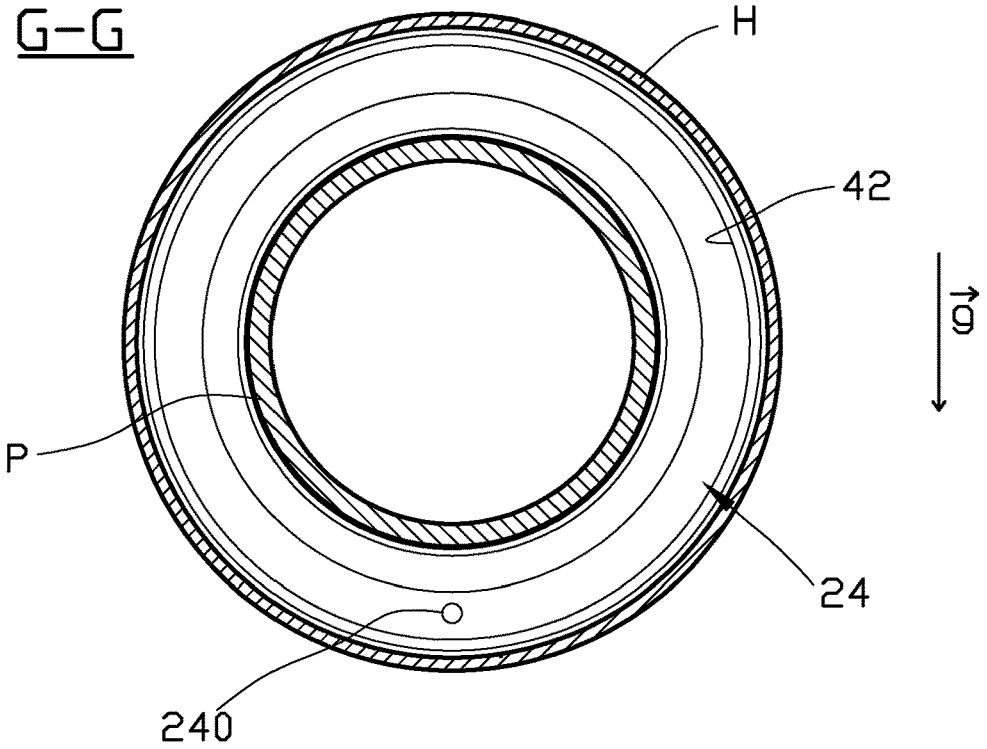
FIG. 6*c* shows a cross-section through G-G of FIG. 6*a;*

In FIGS. 6*a*-6*c*, the valve 1 is provided with a pressure-controlled mechanism for providing a pressure differential across a portion of the piston 20 when the piston 20 abuts the valve seat 40. The pressure-controlled mechanism is responsive to a difference in fluid pressure upstream and downstream of the valve 1, so that a closing force of the valve 1 is added to the piston 20 when said difference in fluid pressure is positive. A purpose of the pressure-controlled mechanism is to facilitate in keeping the valve 1 closed.

In the embodiment shown in FIG. 6*a*, the pressure-controlled mechanism comprises an annular cavity 42 formed in a portion of the second piston portion 24 facing the valve seat 40. However, it should be clear that the annular cavity 42 in an alternative embodiment could be formed in both the second piston portion 24 and the valve seat 40, or in the valve seat 40 only. The point is to create an annular cavity 42 between the valve seat 40 and the second piston portion 24 when abutting each other.

The annular cavity 42 is in fluid communication with the aperture 35 in the barrel P via a piston conduit 240 protruding in an axial downstream direction from the second piston portion 24. The piston conduit 240 extends through an aperture in an annular additional or second valve seat element 40'. When the piston 20 is in its closed position as shown in FIG. 6*a*, a distant end portion 242 of the piston conduit 240 abuts a periphery of the aperture in the additional valve seat element 40'. As indicated in FIG. 6*a*, the periphery is provided with a sealing element.

The valve seat 40, hereinafter also denoted first valve seat element 40, is in the embodiment shown in FIG. 6*a* provided with two channels; a leakage channel 44 configured for providing fluid communication between the venturi and the annular cavity 42, and a pressure communication channel 46 for providing fluid communication between the venturi and an annular conduit chamber 48 defined by the barrel P, the housing H, the additional valve seat element 40', the second piston portion 24 and a portion of the first valve seat element 40.

The purpose of the piston conduit 240 is to provide a pressure within the cavity 42 that is lower than the pressure within the conduit chamber 48. Such a pressure differential will arise due to the fact that the cavity 42 is in fluid communication with the fluid flowing within the barrel P, while the fluid pressure within the conduit chamber 48 is in fluid communication with the high-pressure fluid at the inlet I of the valve 1. Thus, the pressure differential will result in a net pressure force on the piston 20 in an upstream direction, which increases the pressure toward the first valve seat element 40 and the additional or second valve seat element 40'.

The purpose of the leakage channel 44 is to make the valve 1 capable of re-opening if the water for example in a near-wellbore region retreats and is replaced by oil. The leakage channel 46 ensures that old fluid, in this example water, is continuously displaced by new fluid from the reservoir.

If new fluid, such as oil comes back and leaks through a closed valve 1, the water that caused the ball 30 to block the secondary inlet 11, as shown in FIGS. 4*b* and 5*a*, will eventually be drained through the leakage channel 44. If production is then stopped temporarily such that the pressure across the valve 1 equalizes and the ball 30 falls down, one or more springs 23 can be used to enforce re-opening of the valve.

In FIG. 6*a*, a biasing means in the form of one or more springs 49 (one shown in FIG. 6*a*) is provided within the chamber 17. The spring 49 is connected to the first piston portion 22 and to a downstream face of the barrier 7. The purpose of the spring 49 is to facilitate a re-opening of the valve 1 by providing a force in a downstream direction, i.e. towards left in FIG. 6*a*. It should be emphasized that the spring force is relatively small, and of course smaller than a total closing force of the valve 1.

FIGS. 6*b* and 6*c* show cuts through F-F and G-G, respectively, of FIG. 6*a*.

The re-opening mechanism described in relation to FIG. 6*a*, may require pressure equalization across the valve. Such a pressure equalization will typically occur during for example a production shut down by preventing fluid flow within the barrel P.

By providing an inflow control element 30 having a density between that of gas and oil instead of a density between water and oil as discussed above, the valve 1 can be used to block or restrict both water and oil (condensate) when producing gas from a gas field where the production facilities, for example a rig, has a limited capacity for handling liquid.

However, it may be advantageous to provide a valve 1 that is configured for re-opening once the fraction of undesired fluid drops below a predetermined limit, even if there is a pressure difference across the valve. One embodiment of such a valve 1 that is configured to re-open "on the fly" is shown in FIGS. 7*a*-7*g*.

Figure 7A:
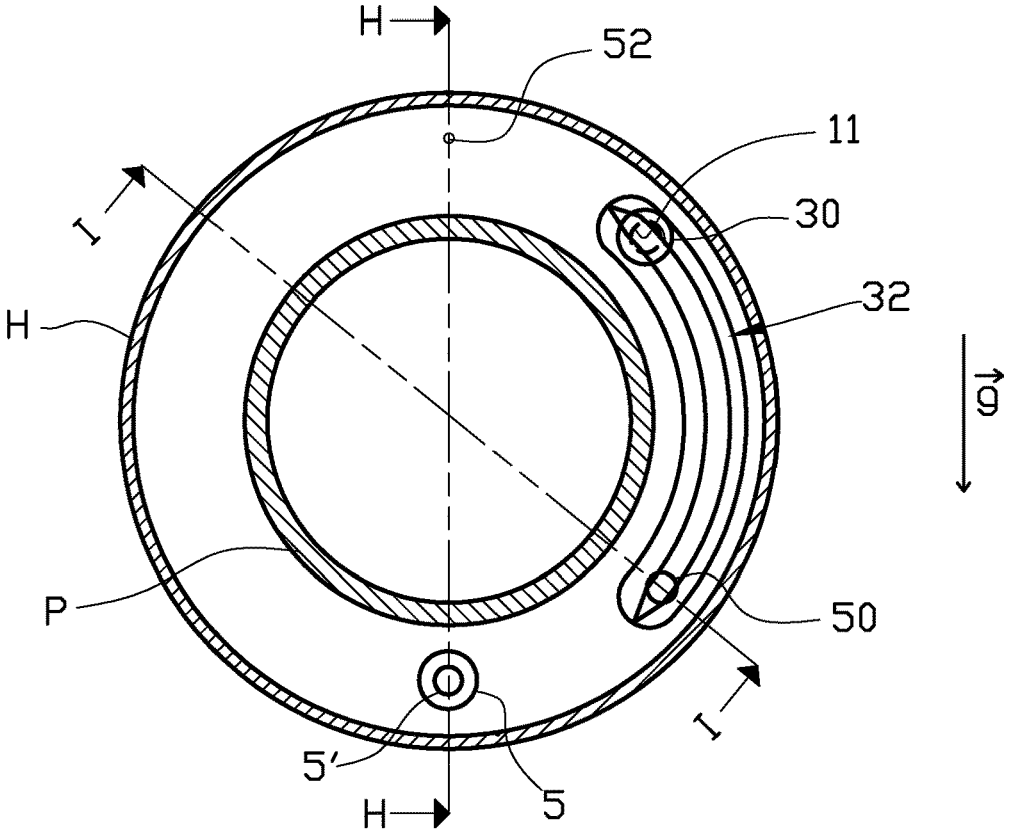
FIG. 7*a* shows a cross-section of an alternative embodiment of the valve, the cross-section taken at the same position as FIG. 4*b;*

FIG. 7*a* is a cross-sectional view of the alternative embodiment of the valve 1 seen from the same position as in FIG. 4*b*, i.e. across the inlet I of the valve 1. The valve 1 shown in FIG. 7*a* differs from the valve 1 shown in FIG. 4*b*.

A first difference is that the barrier 7 is provided with a third inlet 50. The third inlet 50 is additional to the primary inlet 5 and the secondary inlet 11. In the embodiment shown, the third inlet 50 is arranged in the path 32 of the inflow control element 30 and configured to be closed by the inflow control element 30 when this is in the first, or lower, position.

When oil flows through the valve 1, the inflow control element 30 will, due to its density in the embodiment shown being between that of oil and that of water, be located in its lower portion of the path 32, i.e. in the first position. The open or unblocked secondary inlet 11 allows flow through the secondary flow path 9, as discussed above.

Figure 5B:
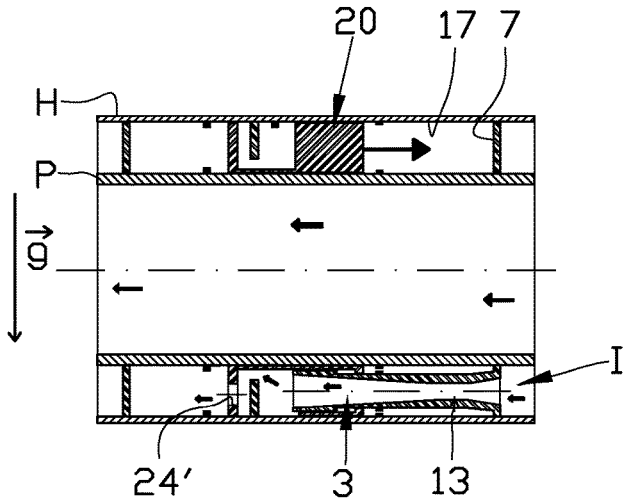
FIG. 5*b* shows in smaller scale the same as FIG. 4*a*, but where a piston is moving from an open position towards a closed position.
Figure 5C:
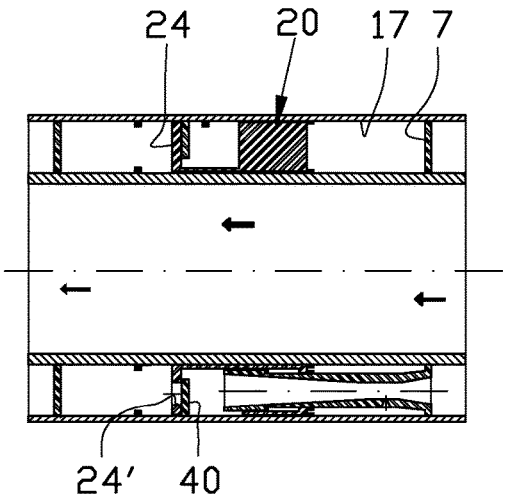
FIG. 5*c* shows the same as in FIG. 5*b*, but where the piston has moved to a closed position.

When the water fraction increases, and the oil-water interface level ascends from the primary inlet 5 to the secondary inlet 11 (for example as indicated in FIG. 3*c*), the ball 30 will move along with said interface and finally block the secondary inlet 11 and cause the piston 20 to move and close the valve 1, as shown in FIGS. 5*b* and 5*c*.

Figure 7B:
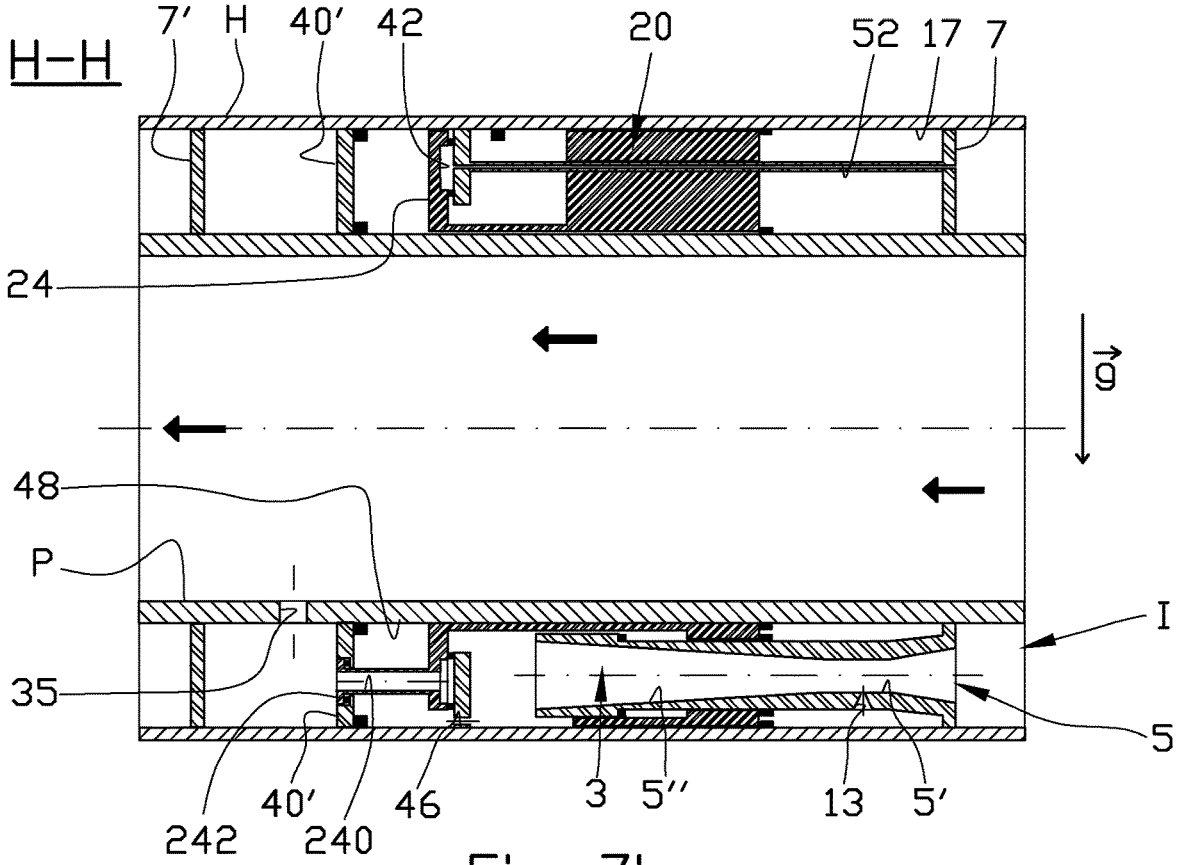
FIG. 7*b* shows an axial cross-section through H-H of FIG. 7*a*, when the valve is closed.

A second difference from the valve 1 shown in FIG. 4*b*, is that a first leakage channel 52 extends through a top portion of the barrier 7. As seen in FIG. 7*b*, the first leakage channel 52 is in fluid communication with the annular cavity 42 of the pressure-controlled mechanism. The first leakage channel 52 replaces the leakage channel 44 for allowing leakage through the valve seat 40 shown in FIG. 6*a*.

Figure 7C:
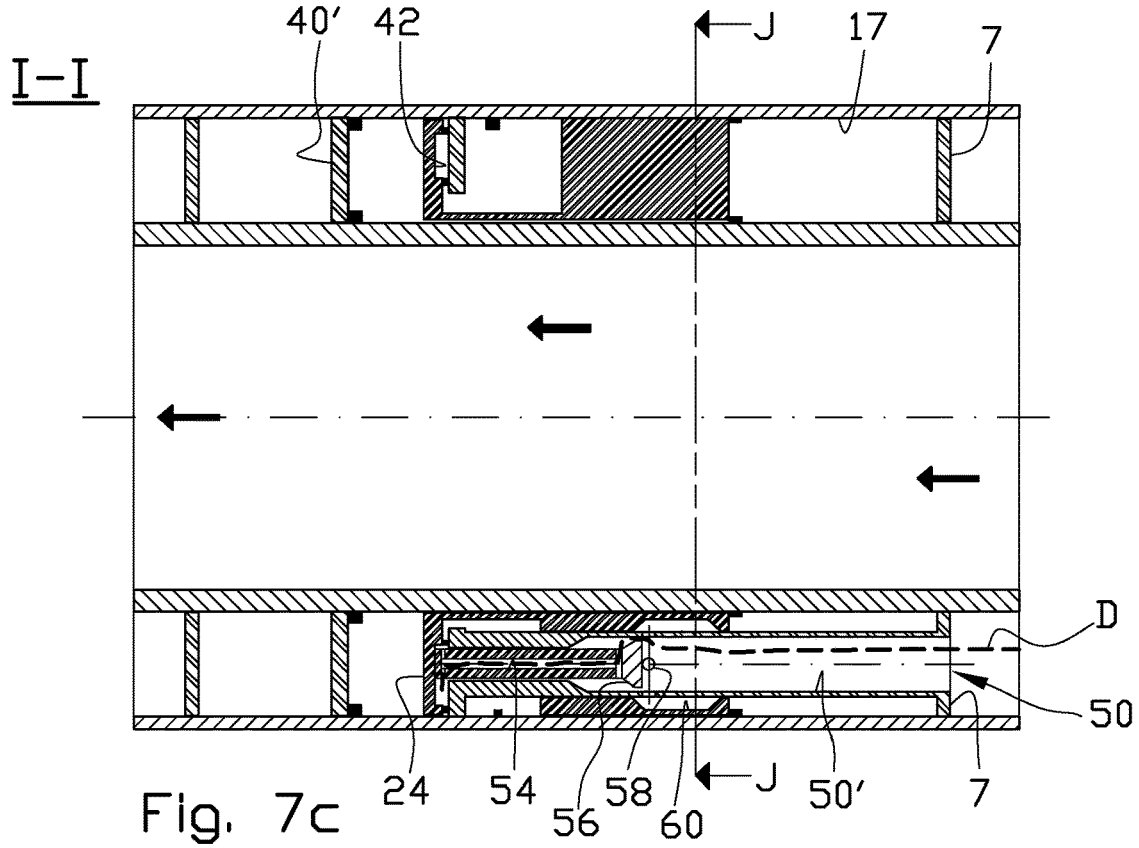
FIG. 7*c* shows the same as FIG. 7*b*, but through cross-section I-I.

FIG. 7*c* is a view through I-I of FIG. 7*a*. The valve 1 is further provided with a second leakage channel 54 connected to and protruding axially from an inner surface of the second piston portion 24 towards the third inlet 50 arranged in a portion of the barrier 7.

The second leakage channel 54 forms part of the axially movable piston 20 and moves together with the piston 20. The second leakage channel 54 is provided with apertures extending radially from end portions of the leakage channel 54. At an upstream end portion, the second leakage channel 54 is provided with an end cap 56. The purpose of the end cap 56 will be explained below.

The third inlet 50 is provided with a channel 50' extending in an axial direction downstream of the third inlet 50. When the valve 1 is closed as shown in FIG. 7*c*, a downstream or left end portion of the channel 50' abuts, via seals, the second end portion 24 of the piston. When the valve 1 is in this closed position, the cavity 42 is in fluid communication with fluid flow upstream of the barrier 7 via the third inlet 50, the channel 50', a clearance between the end cap 56, the radially extending apertures in the second leakage channel 54, and the channel 54 itself. In FIG. 7*c*, the fluid communication path is indicated by a dotted line D. Thus, the leakage channel 54 is open when the valve 1 is closed.

Figure 7D:
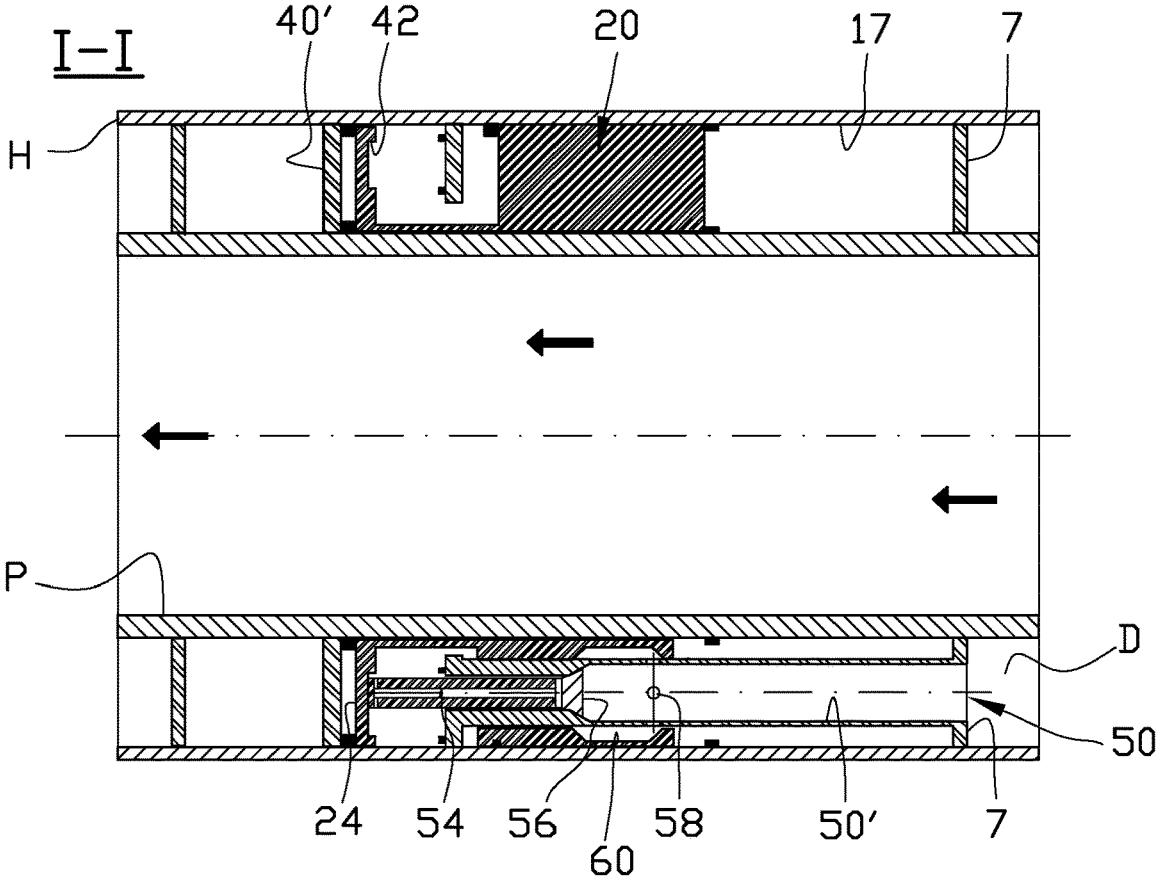
FIG. 7*d* shows the same as FIG. 7*c*, but when the valve is open.

In FIG. 7*d*, the valve 1 is in the open position. The end cap 56, which is connected to an end portion of the second leakage channel 54 operatively connected to the piston 20 as explained above, sealingly abuts an inclined inner wall portion of the channel 50'. A fluid communication between the channel 50' and the second leakage channel 54 is thereby prevented. Thus, the leakage channel 54 is closed when the valve 1 is open.

From the above it should be clear that when the valve 1 is closed, both the first leakage channel 52 and the second leakage channel 54 provide fluid communication between the fluid upstream of the barrier 7, i.e. the inlet I of the valve 1, and the annular cavity 42. Also, when the valve 1 is closed, the fluid pressure across the inflow control element 30 in the secondary inlet 11, will be equalized.

When said pressure is equalized, the inflow control element, here the ball 30, is not prevented from moving within the path 32.

When the valve 1 is closed, the oil-water interface will reside either at the first leakage channel 52 or at the second leakage channel 54, depending on the water fraction and on the diameter ratio of the two leakage channels. For high water fractions, such as for example 80%, the interface may be at the first (upper) leakage channel 52, and for low water fractions the interface may be at the second (lower) leakage channel 54 being in fluid communication with the third inlet 50. The water fraction below which the interface moves from the upper to the lower channel depends on the diameter ratio of the two leakage channels 52, 54, or the equivalent diameter ratio of whatever apertures or flow restrictions that may constitute the smallest cross-sectional flow area along each of the leakage channels 52, 54. If the upper leakage channel 52 has larger diameter than the lower leakage channel 54, the oil-water interface will tend to reside at the upper leakage channel 52, causing the valve 1 to re-open at a high water fraction, and vice versa.

Figure 7E:
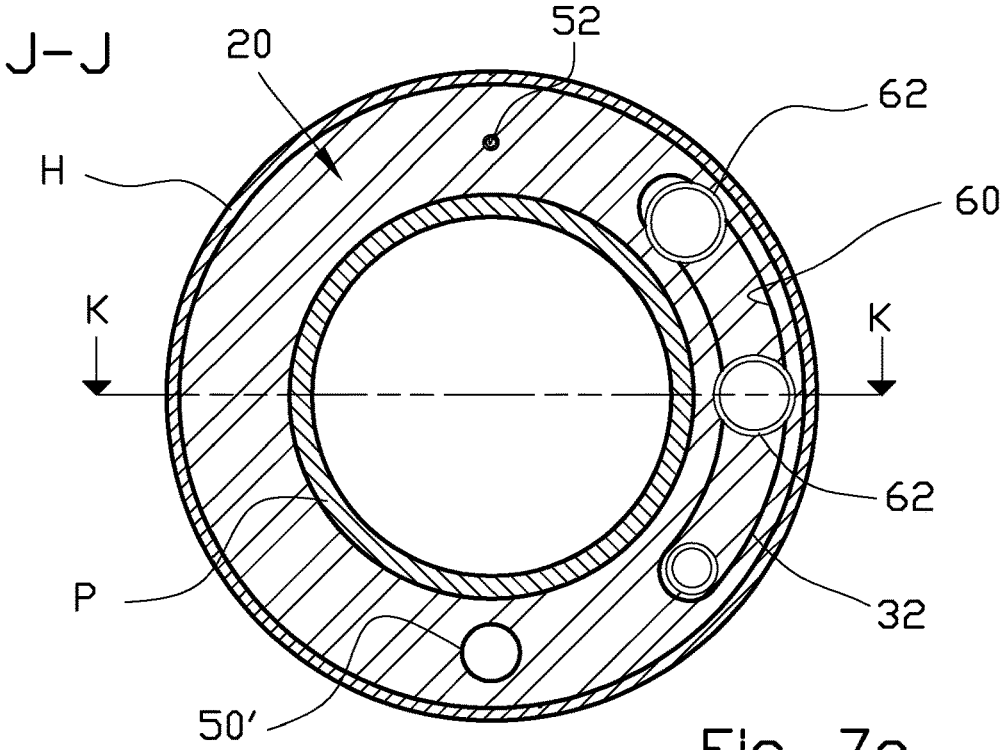
FIG. 7*e* shows an axial cross-section through J-J of FIG. 7*c;*

The channel 50' connected to the third inlet 50 is provided with apertures 58 for providing fluid communication between the channel 50' and a pressure communication channel 60 shown in FIGS. 7*c*-7*e*. As indicated in FIG. 7*e*, the pressure communication channel 60 extends along the path 32 of the inflow control element 30.

If oil comes back and the water fraction drops below the predetermined limit mentioned above, the oil-water interface will descend to the third inlet 50 and bring the ball 30 with it. The ball 30 then blocks third inlet 50. This creates a low pressure in the channel 50' behind the ball 30. This low pressure propagates via apertures 58 though the pressure communication channel 60, to a secondary piston 62 shown in FIGS. 7*f* and 7*g* which are a view through K-K in FIG. 7*e*. In the embodiment shown in FIG. 7*e*, the valve 1 comprises two secondary pistons 62 arranged along the path 32. It should be noted that in an alternative embodiment, the valve 1 may comprise only one or more than the two secondary pistons 62 shown.

Figure 7F:
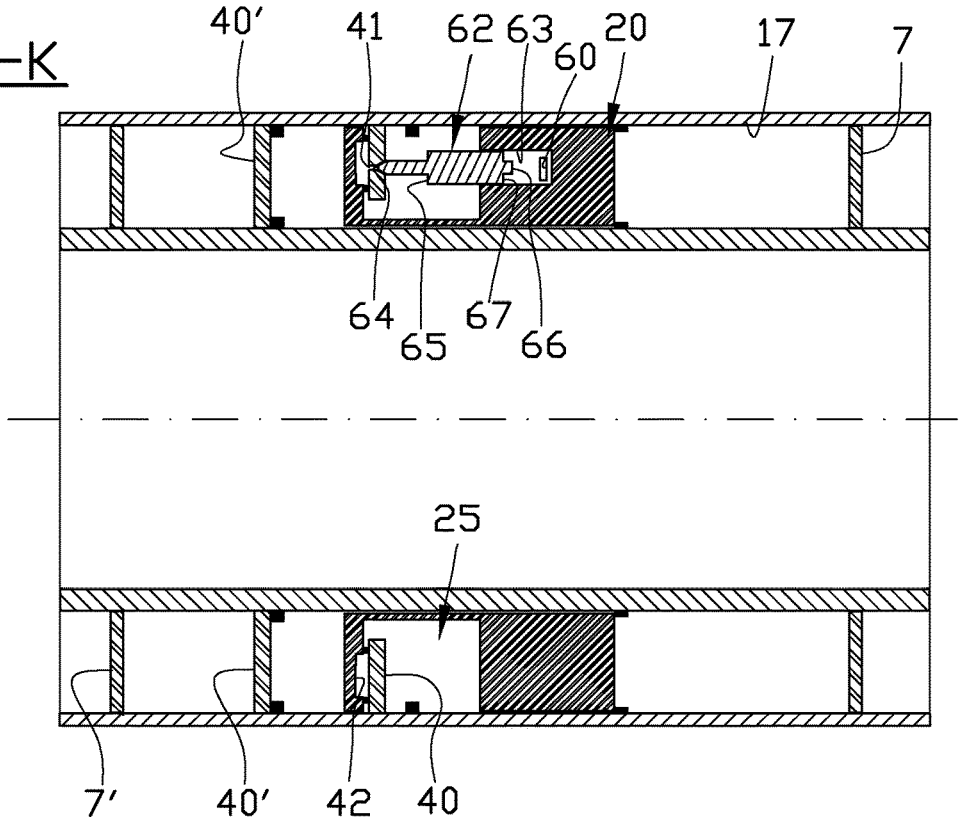
FIG. 7*f* shows a view through K-K of FIG. 7*e*, wherein a secondary piston is in a closed position.
Figure 7G:
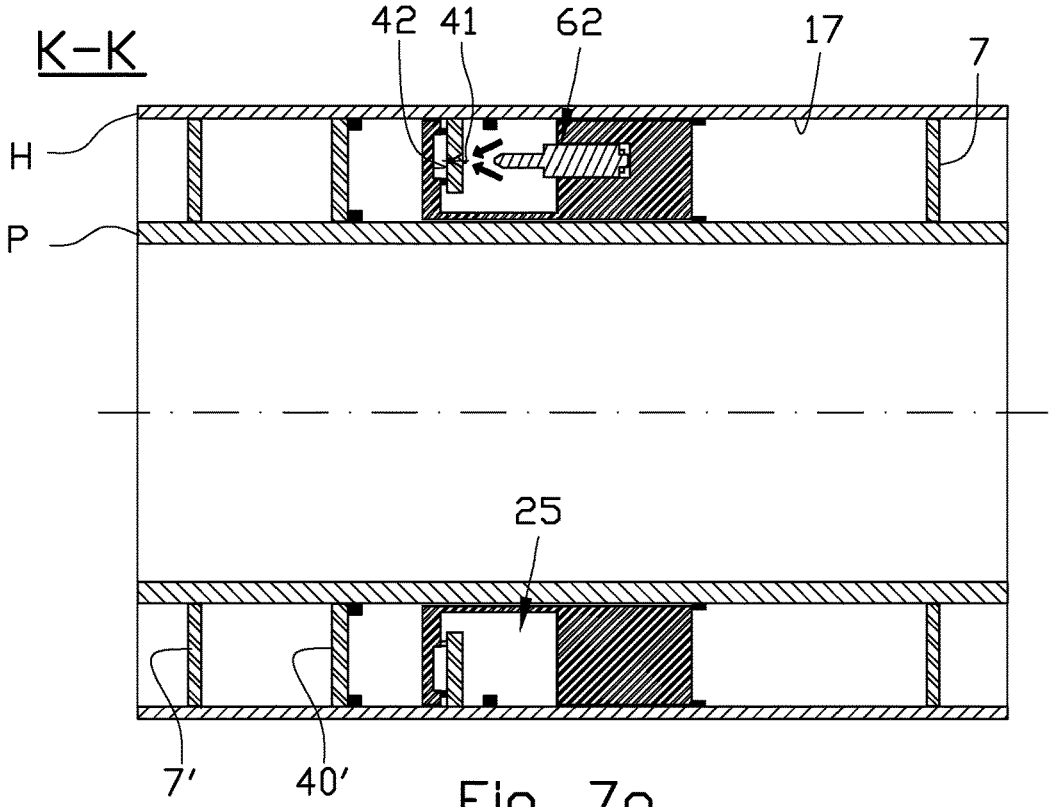
FIG. 7*g* shows the same as FIG. 7*f*, but wherein the secondary piston is in an open position.

The secondary piston 62 is axially movable between an extended position and a retracted position in a piston chamber 63 provided in a portion of the piston 20, as shown in FIGS. 7*f* and 7*g*, respectively. The piston chamber 63 is in fluid communication with the pressure communication channel 60.

The secondary piston 62 is provided with a downstream end surface 64, a downstream intermediate surface 65, an upstream end surface 66 and an upstream intermediate surface 67. The upstream surfaces 66, 67 are within the piston chamber 63 and are thus influenced by the fluid pressure in the pressure communication channel 60. In the extended position, see FIG. 7*f*, the downstream end surface 64 of the secondary piston 62 abuts an opening 41 of the annular wall or valve seat 40. When the valve 1 is closed, the downstream end surface 64 of the secondary piston 62 is subject to the fluid pressure within the cavity 42. The downstream intermediate surface 65 is subject to fluid pressure within the hollow portion 25 of the piston 20, independent of the axial position of the secondary piston 62.

Continuing the discussion above where oil comes back, the low pressure in the channel 50', see for example FIG. 7*d*, propagates though the pressure communication channel 60 and into the piston chamber 63. With low pressure exerted on the upstream end surface 66 and the upstream intermediate surface 67, and also on the downstream end surface 64 being subject to the low pressure within the cavity 42, and with high pressure exerted on the downstream intermediate surface 65, there will be a net pressure force acting on the secondary piston 62 in the upstream direction, causing it to move axially from the position shown in FIG. 7*f* to the position shown in FIG. 7*g* wherein fluid from the primary flow channel 3 flows to the low-pressure cavity 42 as indicated by arrows.

The low-pressure cavity 42 is in communication with the piston conduit 240 extending through an aperture in the annular additional valve seat element 40' as shown in FIG. 6*a*.

With flow through the venturi portion of the primary flow channel 3, the pressure will become lower on the downstream portion 24 than on the upstream portion 22 the piston 20. Because of this press sure differential across the piston 20, the piston 20 will move axially in the downstream direction and thus open the valve 1, as discussed above. In the configuration shown in FIGS. 7*f* and 7*g*, an open valve 1 will cause the at least one secondary piston 62 to be brought back to an original closed position, i.e. a retracted position.

When the piston 20 is in fully open position, the leakage channel 54 will be blocked by the end cap 56 abutting the inclined inner wall portion of the channel 50'. A blocked leakage channel 54 will cause the pressure across the ball 30 to be equalized, such that the ball 30, in the embodiment shown, is free to move upward if the water fraction once again increases and the oil-water level ascends.

In order to avoid a too high leakage flow rate through a closed valve 1, the two leakage channels 52, 54 may be merged into one common channel (not shown) before entering the low-pressure cavity 42. A diameter of the merged leakage channel will determine the total leakage flow rate, whereas the diameter ratio of channel first leakage channel 52 and the second leakage channel 54 will determine the water fraction below which the valve 1 re-opens. The valve 1 will normally be designed to re-open at a water fraction significantly lower than the water fraction where it closes in order to prevent a situation where the valve 1 continuously toggles between closed and open position. By significantly lower is meant for example 10%.

By providing an inflow control element 30 having a density between that of gas and oil instead of a density between water and oil as discussed above, the valve 1 can be used to block or restrict both water and oil (condensate) when producing gas from a gas field where the production facilities, for example a rig, has a limited capacity for handling liquid.

The embodiments of the present invention discussed above are examples of designs suitable for achieving the desired properties of the valve 1. However, numerous alternative designs are possible.

Figure 8A:
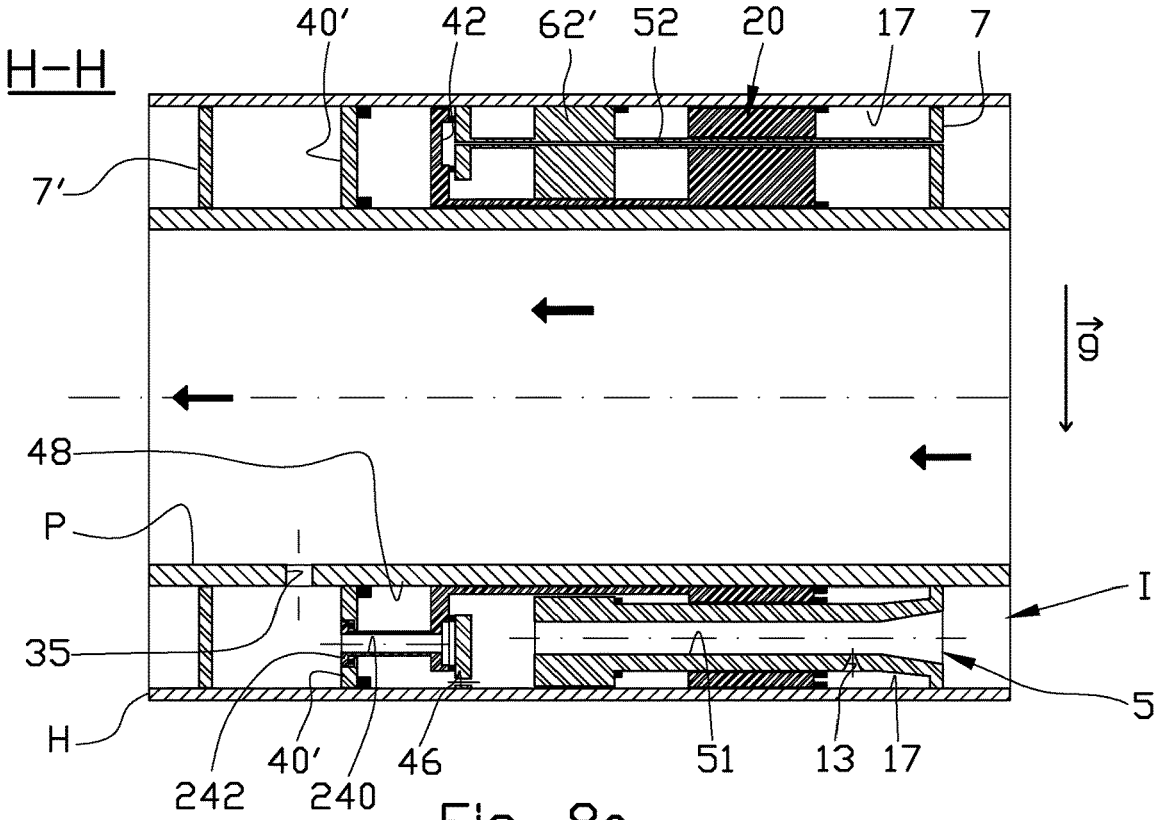
FIG. 8*a* shows an alternative embodiment of the valve shown in FIG. 7*b;*
Figure 8B:
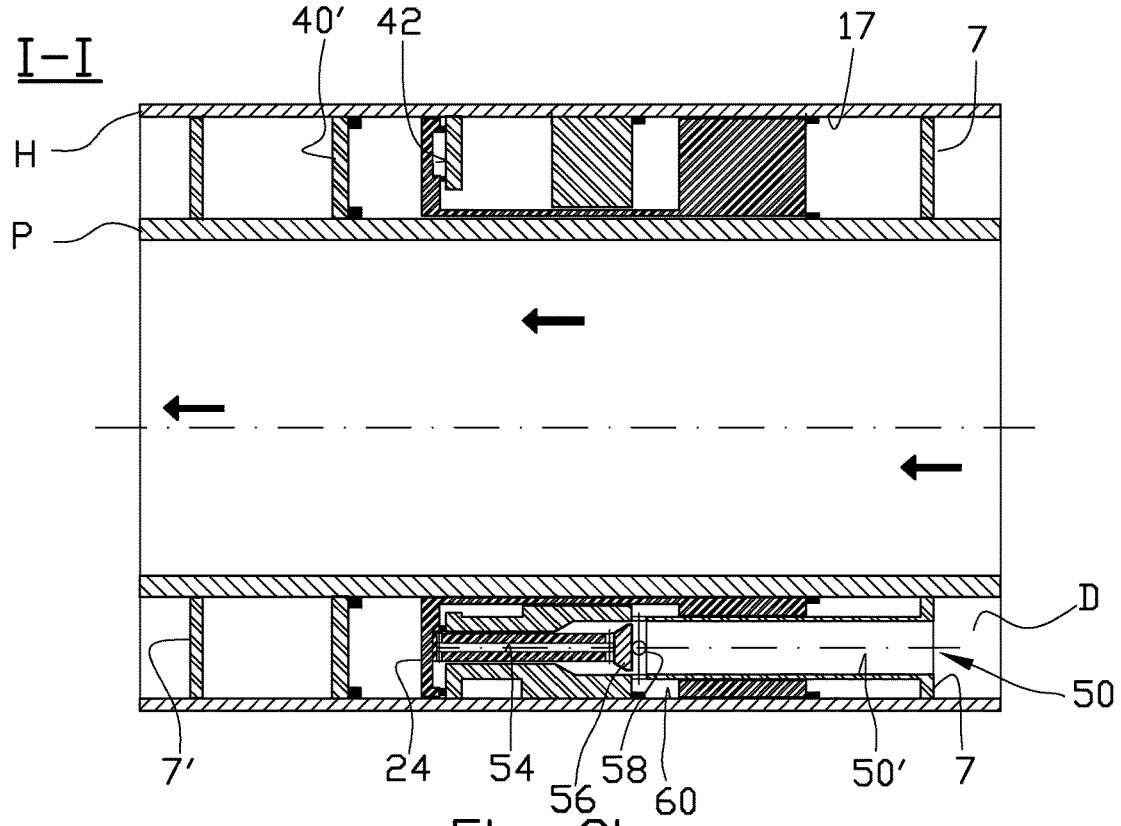
FIG. 8*b* shows an alternative embodiment of the valve shown in FIG. 7*c;*

For example; In FIGS. 8*a* and 8*b*, the secondary piston 62 shown in FIGS. 7*f* and 7*g* has been replaced by a fixed wall 62'. Further, in the embodiments shown in FIGS. 4*a*, 5*a*-5*c*, 6*a*, 7*b*, the venturi portion of the primary flow channel 3 is provided with an expansion section 5". However, in the alternative embodiment shown in FIG. 8*a*, the expansion section 5" shown in previous figures, has been omitted and replaced by a straight pipe 51. Thus, FIG. 8*a* illustrates an alternative embodiment of the valve 1 shown in FIG. 7*b*. FIG. 8*b* illustrates an alternative embodiment of the valve 1 shown in FIG. 7*c*.

When a valve 1 comprising the features shown in FIGS. 8*a* and 8*b*, is water-filled, the ball 30 will block the secondary inlet 11, and the upstream portion 22 of the piston 20 will be exposed to the low pressure in vena contracta 5' via the secondary outlet or pilot hole 13, whereas the pressure communication channel 60 within the piston 20 will be exposed to the full inlet pressure through the apertures 58 in the channel 50'. A net force will therefore push the piston 20 in the upstream direction to the position shown in FIGS. 8*a* and 8*b*, and thereby close the valve 1. If oil comes back and displaces the water through the leakage channels 52 and 54 shown in FIGS. 8*a* and 8*b*, respectively, the ball 30 will descend along its path 32 and finally block the third inlet 50. The piston 20 will then be exposed to the inlet pressure on the upstream side 22 and to the then low pressure within the pressure communication channel 60, causing the piston 20 to move in the downstream direction and re-open the valve 1.

By providing an inflow control element 30 having a density between that of gas and oil instead of a density between water and oil as discussed above, the valve 1 can be used to block or restrict both water and oil (condensate) when producing gas from a gas field where the production facilities, for example a rig, has a limited capacity for handling liquid In the embodiments discussed above in relation to FIGS. 4*a*-8*b*, and in the general principle of the invention shown in FIGS. 3*a*-3*f*, the valve 1 is configured for being responsive to an undesired fluid in the form of water such that the valve 1 closes when the content of water in the flow upstream of the barrier 7 exceeds a predetermined level. However, the valve 1 may in an alternative embodiment be configured for being responsive to an undesired fluid in the form of gas such that the valve 1 closes when the content of gas in the flow upstream of the barrier 7 exceeds a predetermined level.

Figure 9A:
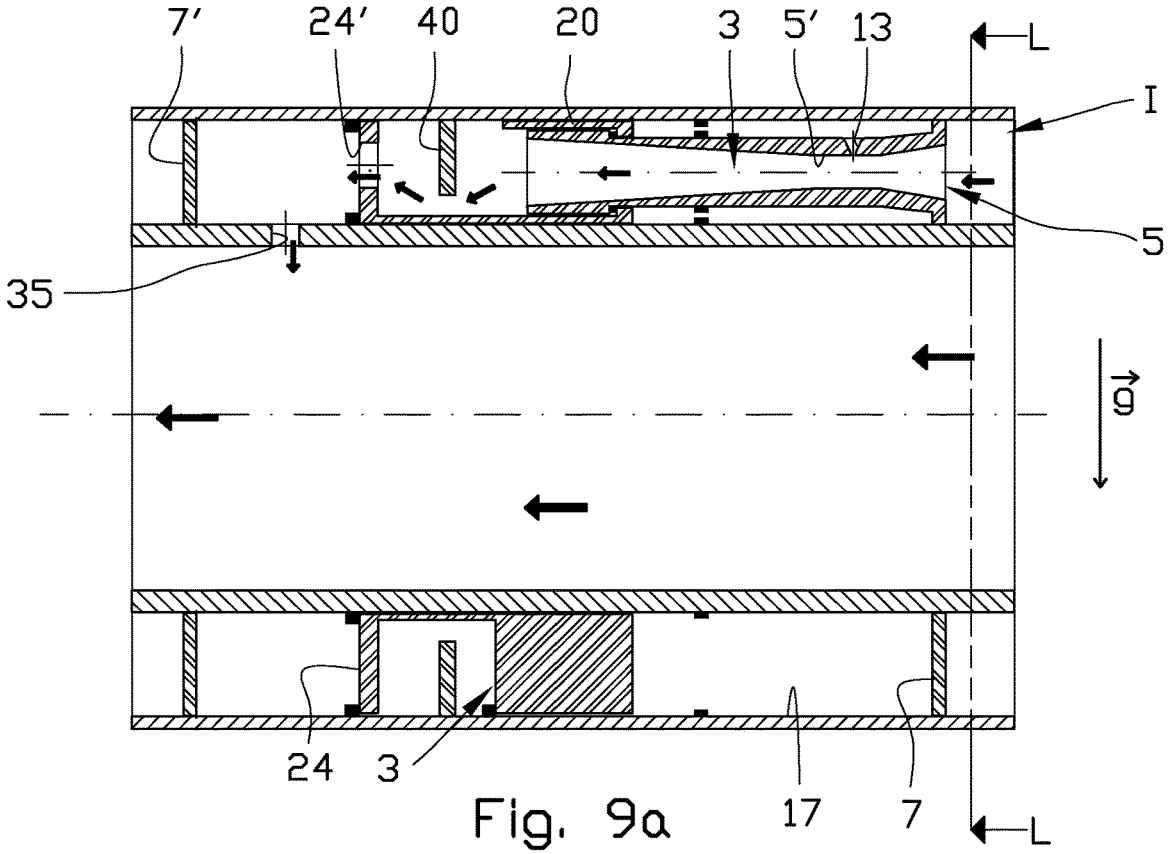
FIG. 9*a* shows an axial cross-section through the valve in an open position, the valve being configured for blocking inflow of gas exceeding a predetermined level.
Figure 9B:
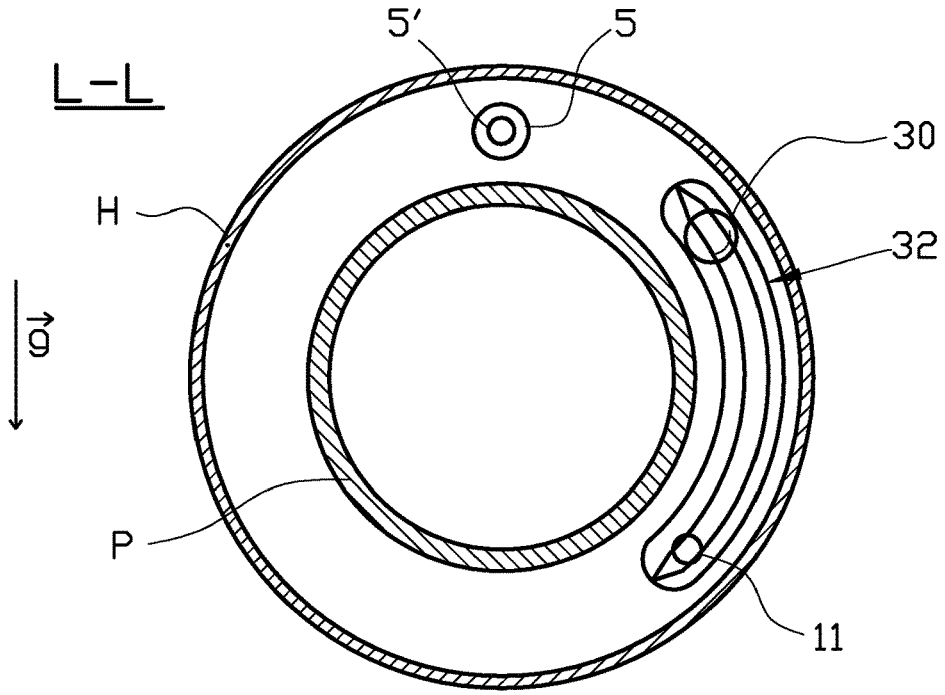
FIG. 9*b* shows a cross-section through L-L of FIG. 9*a* when an inflow control element does not block a secondary inlet of a secondary flow channel.

The valve 1 shown in FIGS. 9*a* and 9*b* is configured for being responsive to gas, and the valve 1 corresponds substantially to the valve 1 shown in FIGS. 4*a* and 4*b*, but rotated 180° around its center axis. However, the density of the inflow control element or ball 30 must have a density between that of oil and gas at in-situ conditions.

As for water, the gas fraction above which the valve 1 closes will be determined by the ratio between the diameter of the secondary outlet or pilot hole 13 and the diameter of the primary flow channel 3 at the vena contracta 5'. The diameter ratio will be designed with respect to reservoir pressure and temperature, which affect the gas density. The pressure reversion principle discussed in relation to FIG. 6*a* and the re-opening mechanism in FIGS. 7*c* and 7*d*, or FIG. 8*b*, can also be used for gas.

After a typical petroleum well has been drilled and completed, and before production starts, the lower part of the well is normally filled with drilling fluid having a density being higher than the density of water. During an initial clean-up process, it is important that this drilling fluid can be produced out of the well without being blocked or restricted by valves 1 that close. One way of achieving this is shown in FIG. 10, where the barrier 7 of the valve 1 is provided with an additional inflow control element 30' arranged in a separate path 32' which resembles the path 32 discussed above.

Figure 10:
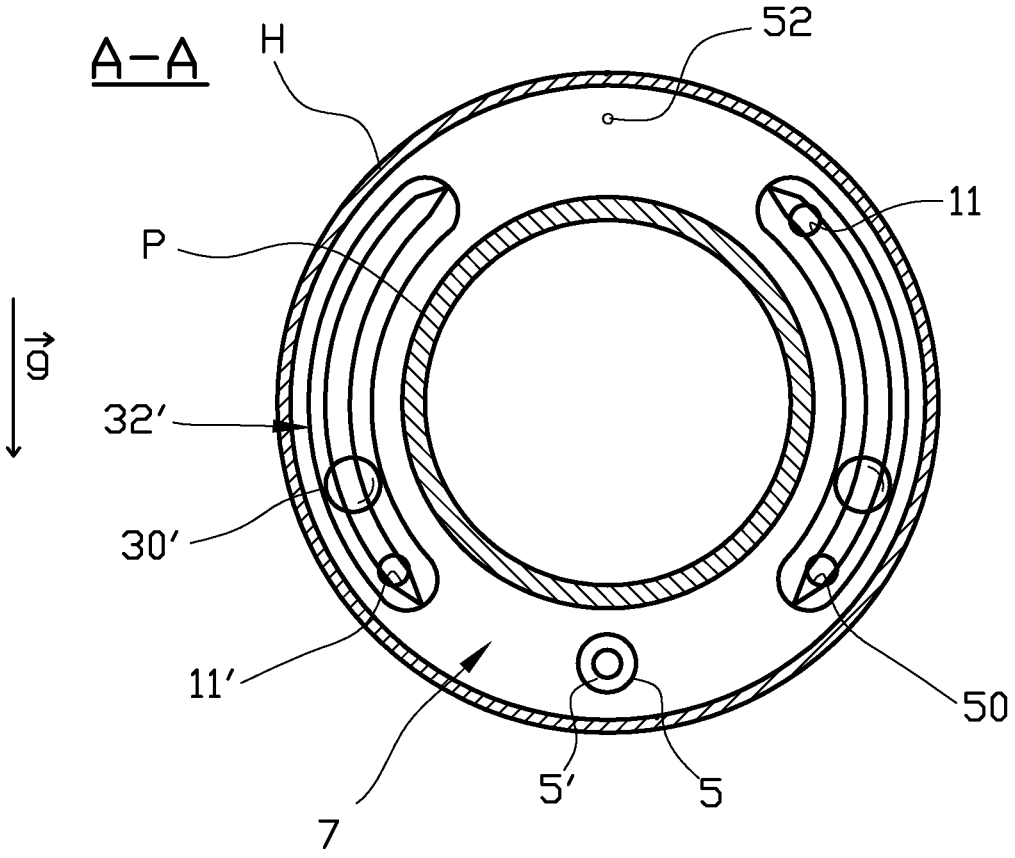
FIG. 10 shows a cross-section of an alternative embodiment of the valve, the cross-section taken at the same position as FIG. 4*b* and FIG. 7*a;*

In the embodiment shown in FIG. 10, the valve 1 is provided with the re-opening mechanism described in relation to FIGS. 7*c*-7*g*.

At a lower end portion, the separate path 32' is provided with an inlet 11' which hereinafter will be denoted drilling fluid inlet 11'. The drilling fluid inlet 11' is in fluid communication with the chamber 17 (see for example FIG. 4*a*) forming part of the secondary flow channel 9.

The additional inflow control element 30', here shown as a ball 30', has a density between that of drilling fluid and water, and is configured to move within the path 32' between a first position wherein the additional inflow control element 30' does not block the drilling fluid inlet 11', and a second position wherein the additional inflow control element 30' blocks the drilling fluid inlet 11'.

As long as drilling fluid flows through the valve 1, both balls 30, 30' will reside at the top of their respective paths 32, 32' since they have a density below that of drilling fluid. With the drilling fluid inlet 11' unblocked, the drilling fluid will flow into the said chamber 17 and consequently exert a high pressure on the first end portion 22 of the piston 20, see for example FIG. 4*a*. Thus, the valve 1 will remain open.

When drilling fluid is subsequently displaced by oil, the additional inflow control element or ball 30' will descend and finally block the drilling fluid inlet 11'. The inflow control element 30 for blocking inflow of water fraction above the predetermined level will remain at the secondary inlet 11 because of a slightly lower back-pressure within the cavity 17. With both inlets 11, 11' blocked, the pressure on the upstream or first end portion 22 of the piston 20 will drop and the valve 1 will close. Immediately thereafter, the valve 1 will re-open because of the automatic re-opening mechanism comprising the third inlet 50.

When the drilling fluid has been drained out of the well, which normally will be for the rest of the life time of the well, ball 30' will remain at the bottom or second position within the path 32' and block the drilling fluid inlet 11', whereas ball 30 will move up and down within its path 32 and thereby close and open the valve 1 depending on the water fraction being produced through the valve 1.

In the embodiments discussed above, the valve 1 comprises an annular piston 20, wherein the first end portion or piston surface 22 fills substantially the cross-sectional area between the inner barrel P and the outer housing H. See for example FIG. 4*d*. An advantage of such an annular piston 20 is that the cross-sectional area of the piston surface 22 is maximized. However, an annular piston 20 may be subjected to friction forces due to its relatively large surface areas of the inner and outer perimeter surfaces, and also to leakage past the inner and outer perimeter. As an alternative to an annular piston 20, one circular piston 20' or two or more circular pistons 20' may be arranged within the annular space between inner barrel P and the outer housing H. Said two or more circular pistons 20' may be interconnected. A valve provided with three circular pistons 20' are indicated in smaller scale in FIG. 4*g*. The purpose of such circular piston(s) 20' is the same as the annular piston 20, i.e. to move axially in order to close the valve 1 when the content of undesired fluid in the flow upstream of the flow barrier 7 exceeds a predetermined level. Contrary to the annular piston 20 discussed above, such circular piston(s) will be without an inner perimeter surface. The circular pistons 20' indicated in FIG. 4*g* are equidistantly distributed and interconnected (indicated by dotted lines) within the annular space defined by the inner barrel P and the housing H, with a centre portion arranged at 0° (top portion in a position of use), at 120° and at 240°. A conceivable advantage of providing circular piston(s) 20' instead of an annular piston 20 shown inter alia in FIG. 4*d*, is that a circular piston by nature has only one outer perimeter and no inner perimeter and thereby a smaller surface area that may be subject to friction force. However, the applicant has calculated a ratio of pressure force to friction force for the two alternatives to determine which approach is more favorable. The calculations show that the ratio of pressure force to friction force is always twice as large for the annular valve as for the circular valve. This applies to all basepipe and housing dimensions. The applicant therefore prefers the annular piston 20 as disclosed herein.

It is possible to increase the total force towards the piston 20 if the piston is made up of multiple interconnected discs (not shown) stacked in the axial direction, where each disc has a low-pressure side and a high-pressure side. All low-pressure sides should in such a "stacked" embodiment be in mutual pressure communication, and all high-pressure sides should also be in mutual pressure communication. The total force acting on the piston will then be increased by a factor whose theoretical maximum equals the number of discs.

Turning now to FIGS. 11*a*-13 concerning a system 100 comprising at least one valve 1 according to the present invention. The system 100 according to the invention provides additional features for controlling inflow of a fluid from the well W and into for example a production string PS.

Figure 11A:
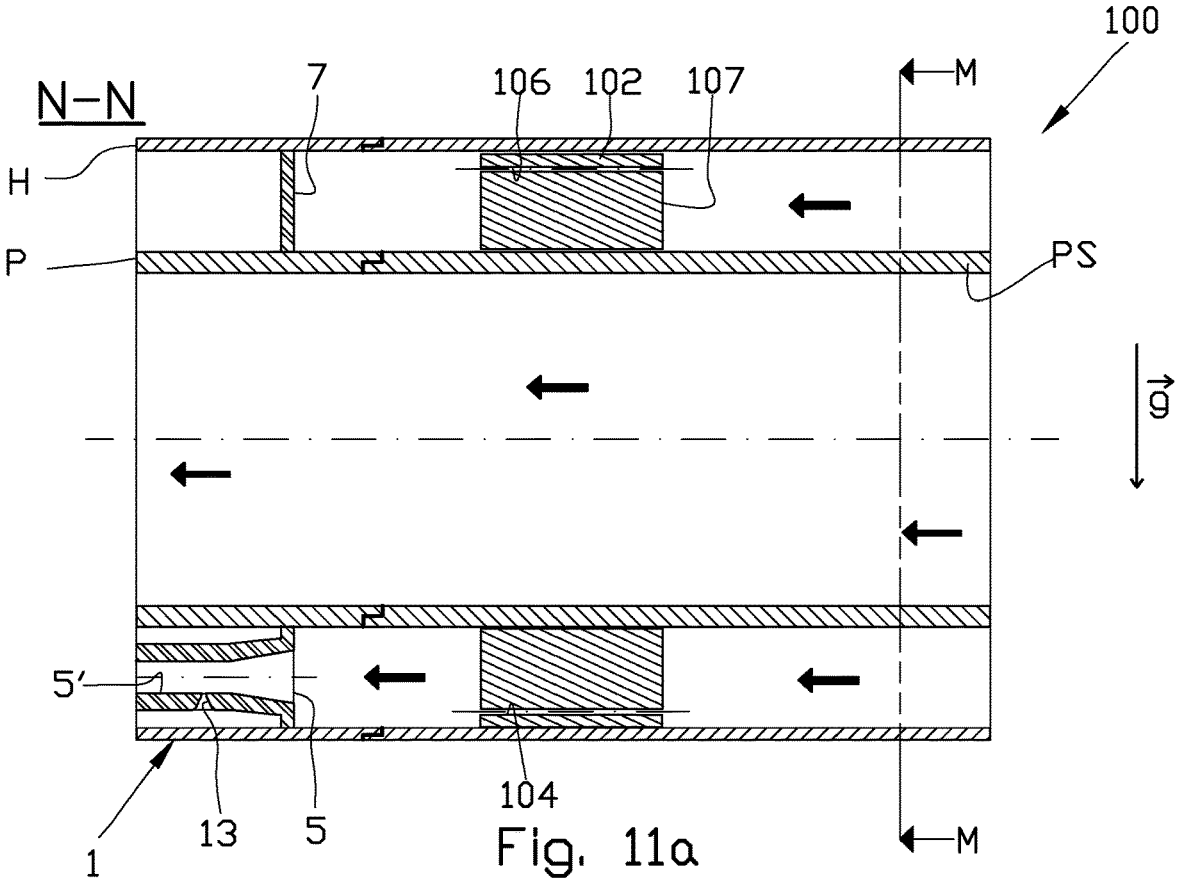
FIG. 11*a* shows an axial cross section of a system according to the present invention, the system comprising the valve and a diverting device arranged upstream of the valve, the axial cross-section taken through N-N of FIG. 11*b;*

In FIG. 11*a*, the system 100 further comprises an annular diverting device 102. The diverting device will hereinafter also be denoted a cleanup module 102. The diverting device or cleanup module is arranged upstream of a partly shown valve 1 in a portion of the production string PS as indicated, or in a portion of the barrel 1. In the embodiment shown, the cleanup module 102 is arranged in a similar annulus as the valve 1, such that the cleanup module 102 is arranged in series upstream of the valve 1.

In the embodiment shown, the cleanup module 102 is provided with a lower leakage channel 104 and an upper leakage channel 106 a purpose of which will be discussed below.

Figure 11B:
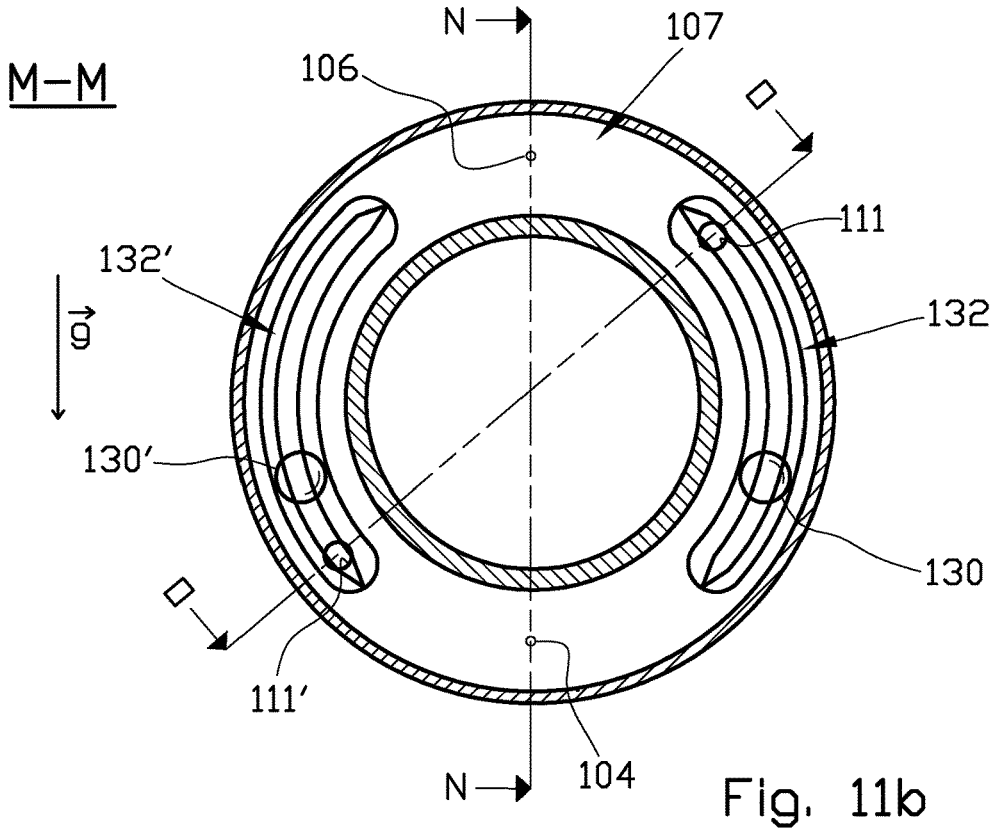
FIG. 11*b* shows a cross-section through M-M of FIG. 11*a;*

FIG. 11*b* is an upstream view through M -M of FIG. 11*a*, i.e. seen from right to left. The cleanup module 102 is provided with an upstream cleanup module barrier wall 107 provided with diverting device or cleanup module inflow control elements 130, 130' arranged movable in paths 132, 132', respectively, similar to the paths 32, 32' for the inflow control elements 30, 30' for the valve 1 discs cussed above. Hereinafter, the inflow control elements 130, 130' will be denoted first inflow control element 130 and second inflow control element 130', respectively.

The first cleanup module inflow control element 130 is arranged in a first path 132. In the position of use, a top end portion the first path 132 is provided with a first inlet 111 of a first channel 112 shown in FIG. 11*c*.

The second cleanup module inflow control element 130' is arranged in a second path 132'. In the position of use, a bottom end portion the second path 132' is provided with a second inlet 111' of a second channel 112'.

Both of the cleanup module inflow control elements 130, 130' have a density between that of drilling fluid and that of water.

Figure 11C:
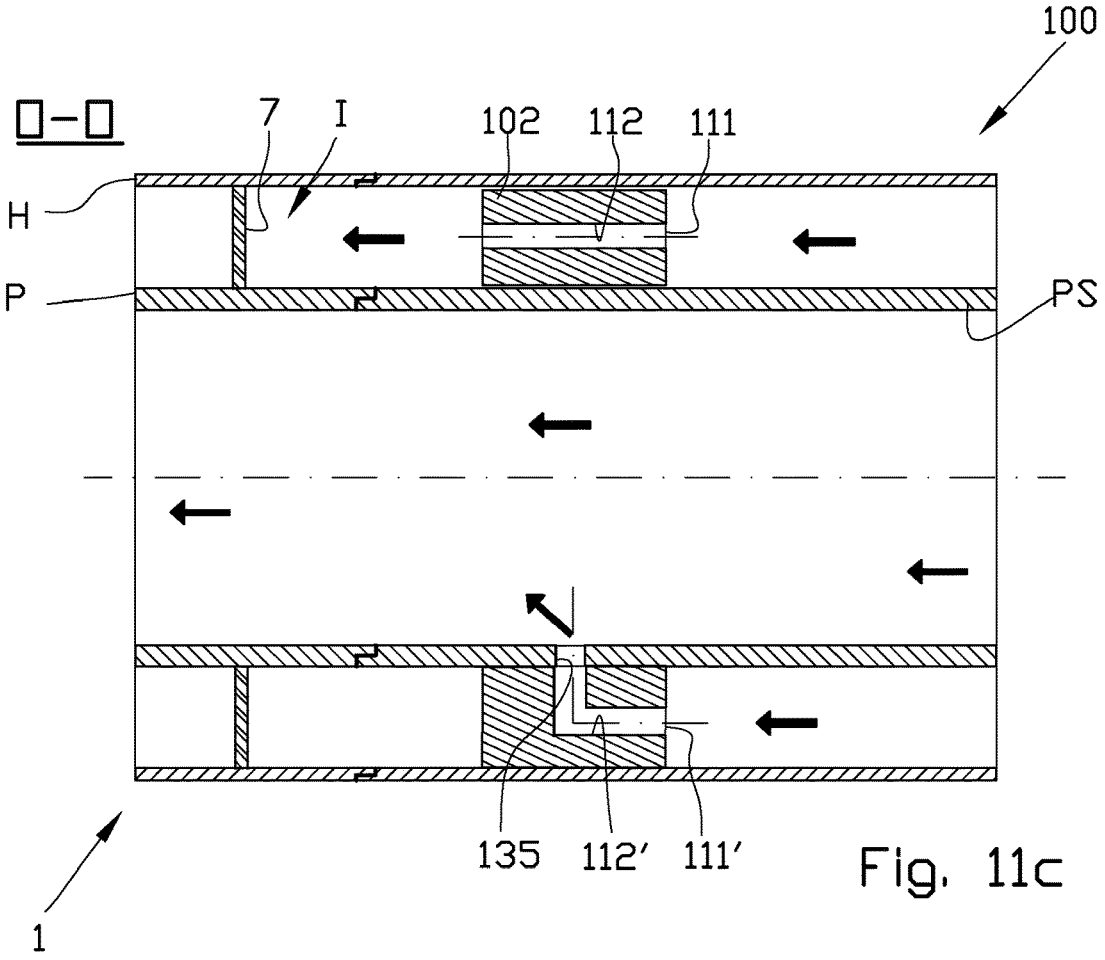
FIG. 11*c* shows a cross-section through O-O of FIG. 11*b;*

As shown in FIG. 11*c*, the first channel 112 extends straight through an upper portion of the cleanup module 102, while the second channel 112' provides fluid communication between the second inlet 111' and an outlet 135 arranged in a wall portion of the barrel P or production string PS. Thus, the first channel 112 provides fluid communication from an upstream portion of the cleanup module 102 to an upstream or inlet portion I of the valve 1 (not shown in FIG. 11*c*), and the second channel 112' is configured to divert the fluid flow into the production string PS upstream of the valve 1 so is that the fluid flow bypasses the valve 1.

When the fluid in the system is drilling fluid, both of the cleanup module inflow control elements 130, 130' will be in the upper position of the paths 132, 132', respectively. Thus, the first inlet 111 will be blocked while the second inlet 111' will be open. The drilling fluid will therefore flow through the second channel 112' only, i.e. into the production string PS and not to an inlet portion I of the subsequent valve 1.

When the drilling fluid is eventually displaced by reservoir oil, the second cleanup module inflow control element or ball 130' will descend and finally block the second inlet 111' and thereby the second channel 112'. However, the first cleanup module inflow control element or ball 130 will not fall down because leakage through the leakage channels 104, 106 in the cleanup module 102 and the leakage channels 52, 54 in the valve 1, see FIGS. 7*c* and 7*d*, will cause a back- or downstream pressure on the first ball 130 to be lower than the front or upstream pressure. This means that both the first channel 112 and the second channel 112', will be blocked, and there is only a small leakage rate through the leakage channels 104, 106 and through the subsequent valve 1. When the cleanup module 102 closes in this way and the total flow rate from the well W is kept constant by opening a topside or seabed choke more, a lower back-pressure is exerted on valves that may be located further upstream in the reservoir section, see FIG. 1. This will in turn increase the pressure drawdown from the reservoir and thereby make the drilling fluid removal more efficient and complete.

When the cleanup process is eventually stopped, and the pressure is equalized across all valves 1 and cleanup modules 102 that may have been provided along a portion of the well W (for example the well W shown in FIG. 1), the first ball 130 will descend, uncover the first inlet 111 and thus open the first channel 112, such that oil can subsequently be produced through the subsequent downstream valve 1. The second channel 112' will remain blocked by second ball 130' for the rest of the lifetime of the producing well W.

Figure 12:
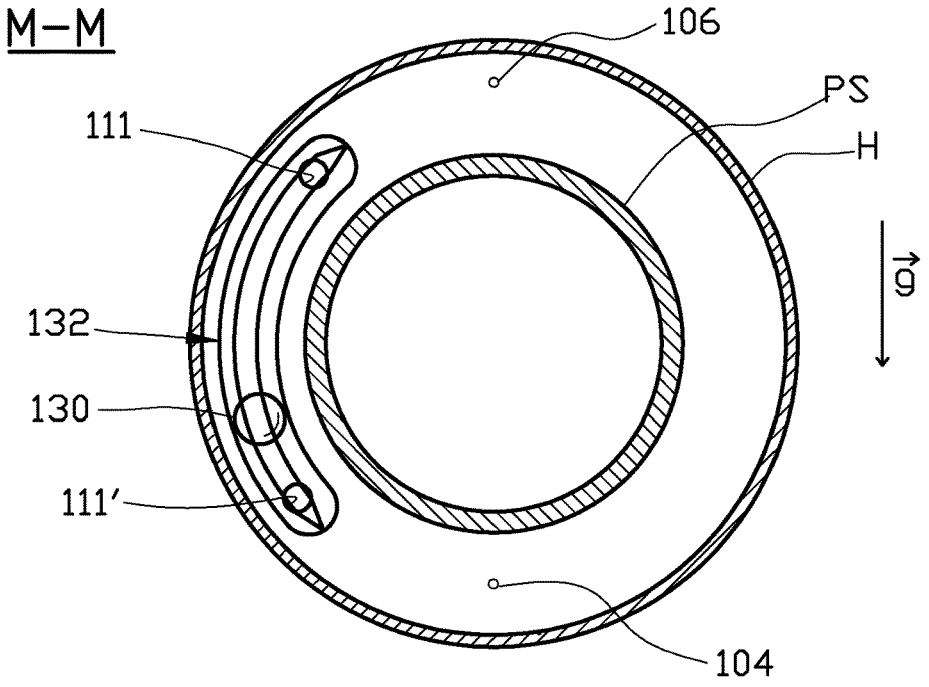
FIG. 12 shows a cross-section of an alternative embodiment of a clean-up module for a toe-section of a well, the cross-section taken at a similar position as shown in FIG. 11*b*, i.e. upstream of the clean-up module.

Towards the end of the cleanup process discussed above, when all the drilling fluid has been removed from a reservoir section of a well W, all the valves 1 will eventually be closed. Such a situation might choke the well W too much and make it impossible to maintain a high and constant cleanup rate throughout the full duration of the cleanup process. In order to avoid that the last valves 1 (those located in a toe section of the well) close, an alternative design shown in FIG. 12 can be used for the valves 1 in the toe section. FIG. 12 is an alternative of the embodiment shown in FIG. 11*b*.

In the alternative design shown in FIG. 12, the cleanup module barrier 107 comprises an upper, first inlet 111 and a lower, second inlet 111' arranged in end portions of a path 132 for an inflow control element 130.

The first inlet 111 is an inlet of a channel 112 extending in an axial direction through the cleanup module 102. Thus, the first inlet 111 and corresponding channel 112 correspond to the first inlet 111 and the appurtenant channel 112 shown in FIG. 11*c*.

The second inlet 111' is an inlet of a second channel 112' that is configured to divert the fluid flow into the production string PS upstream of the valve 1 so that the fluid flow bypasses the subsequent valve 1. Thus, the second inlet 111' corresponds to the second channel 112' shown in FIG. 11*c*.

When drilling fluid is displaced by oil, cleanup module inflow control element 130' will not fall down because it has lower back-pressure than front pressure as a result of leakage through channels 104, 106 shown in FIG. 11*a*. Oil can therefore continue to flow through the second channel 112', i.e. directly into the production string PS.

Independent of the embodiment shown in FIG. 11*b* or the alternative embodiment shown in FIG. 12, the cleanup module 102 according to the invention is configured for diverting the fluid flow into the production string PS upstream of the barrel P and the valve 1 so that the fluid flow bypasses the valve 1 when fluid upstream of the cleanup module 102 is drilling fluid, and for allowing flow of fluid through the cleanup module 102 and to the inlet I of a subsequent valve 1, or valves, when the cleanup module 102 is exposed to a fluid having a density being less than the density of the inflow control element.

When the cleanup process is finished and the flow from the well W is stopped, such that the pressure is equalized across the valve 1, the second cleanup module inflow control element 130' shown in FIG. 11*b* or the inflow control element 130 shown in the alternative embodiment shown in FIG. 12, will descend and block the second inlet 111' and thus the second channel 112', and unblock the first inlet 111 and thus the channel 112 for subsequent oil flow through the subsequent valve 1.

If it is desired to block or restrict both gas and water from an oil-producing well, a series of at least two differently configured valves 1 may be utilized. For example, the valve 1 shown in FIGS. 9*a* and 9*b* which is configured for closing the valve 1 when a content of gas upstream of the barrier 7 exceeds a predetermined level, may be arranged downstream of a valve 1 shown for example in FIGS. 4*a* and 4*b* or any of the other embodiments of the valve 1 configured for closing the valve 1 when a content of water upstream of the barrier 7 exceeds a predetermined level. In what follows the valve 1 shown in FIGS. 9*a* and 9*b* will also be denoted "gas valve" 1G, while the valve 1 shown for example in FIGS. 4*a* and 4*b* will also be denoted "water valve" 1W.

Figure 13:
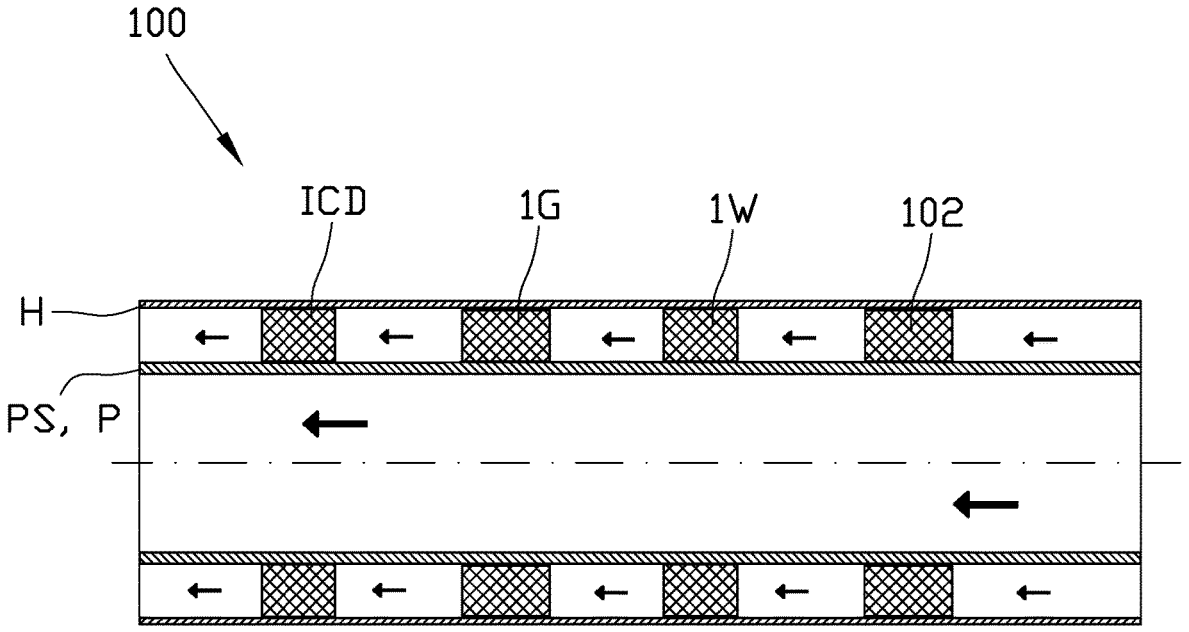
FIG. 13 shows in smaller scale, an axial cross section of a principle arrangement of a system comprising a clean-up module, valves and a known inflow control device arranged in series along a portion of a well.

FIG. 13 is an axial cross section of a principle arrangement of a system 100 comprising (from right to left) a cleanup module 102, a water valve 1W, a gas valve 1G and an ICD module (ICD—Inflow Control Device) arranged downstream of the gas valve 1G. The ICD is a commercially available product and is known to a person skilled in the art. The purpose of the ICD module is to create an extra pressure drop across the system 100 when fluid flows through the system 100, in order to enforce a more uniform inflow profile from the reservoir, which in turn can contribute to delayed gas and/or water breakthrough and therefore a more favourable reservoir drainage of the reservoir F indicated in FIG. 1.

The ICD can either be a simple orifice with a small diameter, or it can consist of several parallel orifices with different sizes, where only one orifice is selected by configuring the ICD module manually prior to installation in the well W, or by using a downhole tool that can rotate the ICD module to the desired position from the inside after installation. The ICD module may also be provided with a permanent check valve (not shown) configured for preventing so-called reversed flow through the ICD module, gas valve 1G and water valve 1W.

However, a possibility for reversed fluid flow may be required during various well operations like scale squeeze and wellkill. Such a reversed fluid flow can be achieved by flowing fluid through the second channel 112' in the cleanup module 102, wherein the second cleanup module inflow control element 130' will simply be pushed aside from the second inlet 111' when backflowing through channel 112'.

In some wells, drilling fluid is displaced from the reservoir section prior to cleanup and before swell packers PA (see FIG. 1) have expanded. A clean fluid, such as for example a base oil, is then pumped down the basepipe P (see FIGS. 1 and 2) to TD (TD—Total Depth) and back up in the annular space between a lower completion CS and the sandface. The drilling fluid is then pushed up into the cased annulus. In order to ensure an efficient process whereby all the drilling fluid is displaced from the reservoir section, it is important to avoid backflow through the valves 1 as this will represent short-circuits for the flow. In order to avoid said backflow, temporary check valves can be installed in the cleanup module 102 of the system 100, which prevent backflow and thereby force the flow all the way to TD before returning in the annulus. The check valve can be made temporary by using a material that dissolves after some time of oil production. Such a temporary check valve is known to a person skilled in the art.

The modular valve assembly shown in FIG. 13 may also comprise a fail-safe mechanism, e.g. in the form of a sliding sleeve (not shown) arranged on an inner surface of the pipe P, wherein such a sliding sleeve is configured to be pulled open from the inside by a well tool (not shown). The failsafe mechanism may also be an integral part of the cleanup module 102 or a separate module placed upstream of the cleanup module 102. An example of a suitable sliding sleeve is disclosed in Norwegian patent publication NO 334657.

Figure 14A:
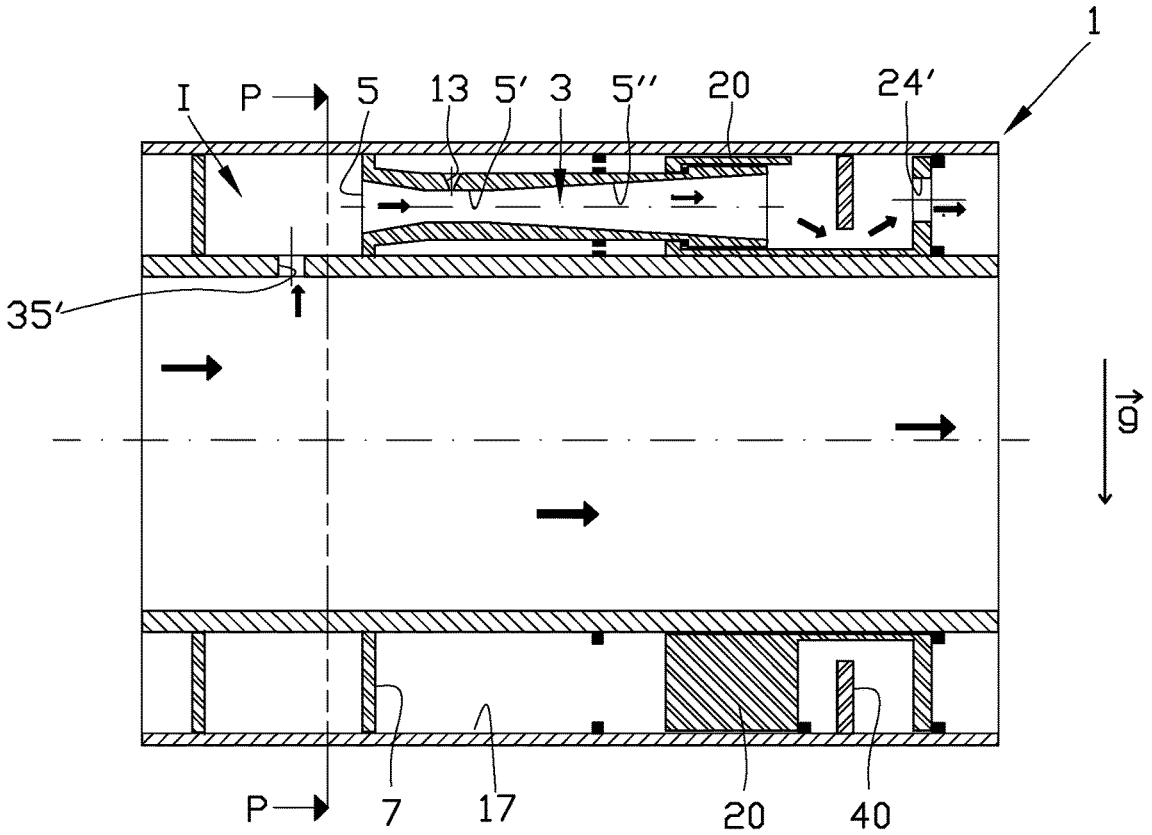
FIG. 14*a* shows an axial cross section of a basic valve arrangement for a Water Alternating Gas (WAG) injection well, the valve being based on the principle of the valve shown in FIG. 9*a*.
Figure 14B:
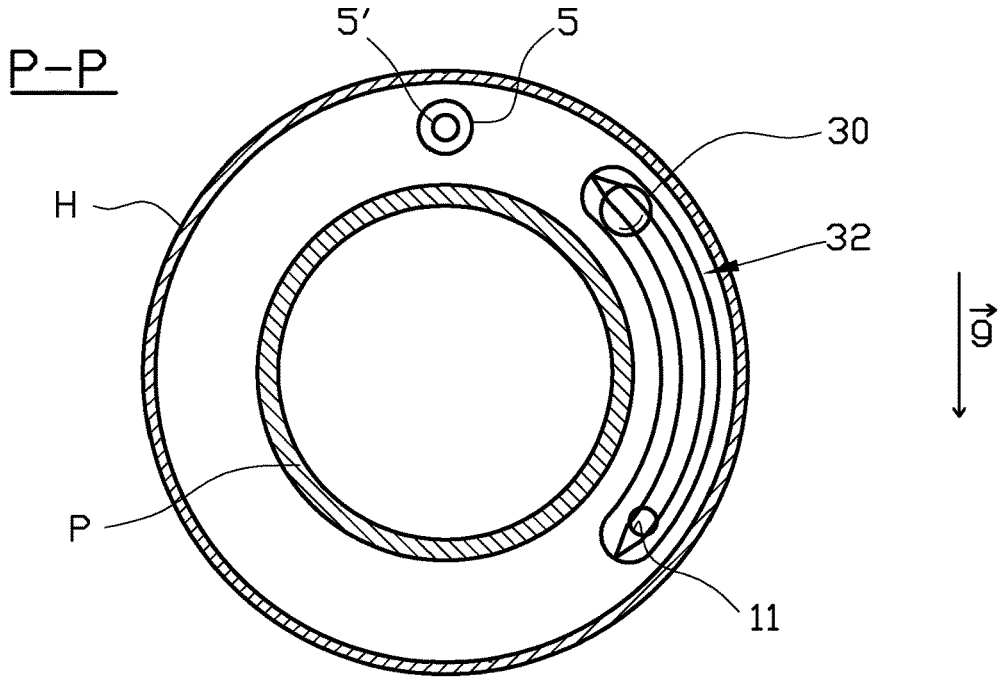
FIG. 14*b* shows a cross-section through P-P of FIG. 14*a*.

Yet another use of the invention can be found for WAG injection wells (WAG—Water Alternating Gas). In order to obtain a more uniform outflux profile along the reservoir section when gas is injected, it is desirable for some WAG injection wells to restrict the outflow of gas more than the outflow of water. This can be achieved by the embodiment in FIG. 14*a* which has similarities to the embodiment shown in FIG. 9*a*, but wherein the valve 1 is "mirrored" with respect to an imaginary vertical axis so that the inlet 5 of the valve 1 receives the "reversed" fluid flowing from the inside of the basepipe P, via the inlet 35' to the inlet I upstream of the inlet 5.

The inflow control element 30 in the WAG application should have a density between that of water and gas at in-situ conditions. The leakage channel 44 should be have a diameter that provides the desired hydraulic resistance for gas.

The pressure reversion principle shown and discussed in relation to FIG. 6*a* and the re-opening mechanism shown and discussed in relation to in FIG. 7*c* or FIG. 8*b* can also be used for WAG wells.

From the disclosure herein, a person skilled in the art will appreciate that the valve 1 according to the present invention is an AICD (Autonomous Inflow Control Device) that operates independently of fluid viscosity, flow rate and Reynolds number, and that is also capable of reliably blocking or restricting the unwanted fluid for all flow rates once the volume fraction of the unwanted fluid exceeds a predefined limit. The valve 1 has very few movable parts and operates in response to phase split, i.e. volume fractions of desired and undesired fluids flowing through the valve 1.

Embodiments of the valve 1 according to the invention provides reliable re-opening mechanisms.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A valve for closing fluid communication between a well and a production string when a content of an undesired fluid in the fluid flow exceeds a predetermined level, the valve comprising:

a primary flow channel having a primary inlet through a flow barrier, and a low pressure portion;

a secondary flow channel connected to the primary flow channel at the low pressure portion, the secondary flow channel having a secondary inlet through the flow barrier and provided with a flow restrictor;

a chamber in connection with the secondary flow channel;

a piston arranged in the primary flow channel for opening and closing the primary flow channel, the piston defining a portion of the chamber in connection with the secondary flow channel;

an inflow control element movable between a first position and a second position in response to a density of a fluid;

wherein the inflow control element is exposed to the fluid flow upstream of the flow barrier and is arranged to move to the second position and close the secondary inlet when the content of the undesired fluid in the flow upstream of the flow barrier exceeds the predetermined level; and wherein the closing of the secondary inlet causes an underpressure in the chamber such that the piston is activated and the valve is closed.

2. The valve according to claim 1, wherein, in a position of use, the primary inlet is arranged at a first elevation, and the secondary inlet is arranged at a second elevation that is different from the first elevation.

3. The valve according to clam 1, wherein the inflow control element is a flotation element movable in a path arranged at an upstream side of the flow barrier, the path extending between the first position and the second position.

4. The valve according to claim 1, wherein the inflow control element has a density between a density of a desired fluid and the density of the undesired fluid.

5. The valve according to claim 1, wherein the piston is axially movable within a portion of an annulus defined by:

an inner tubular body being in fluid communication with the production string;

a housing arranged coaxially with and surrounding a portion of the inner tubular body;

a downstream barrier arranged within the annulus and axially spaced apart from the flow barrier;

wherein the annulus further comprises a stationary valve seat arranged between the downstream barrier and the flow barrier so that the piston abuts the valve seat when the valve is closed, and the piston does not abut the valve seat when the valve is open.

6. The valve according to claim 5, wherein the valve seat comprises a first valve seat element and a second valve seat element axially spaced apart from the first valve seat element, a portion of the piston being movable between the valve seat elements, the piston abutting both valve seat elements when in the closed position.

7. The valve according to claim 6, further provided with a pressure-controlled mechanism for providing a pressure differential across a portion of the piston when the piston abuts the valve seat, the pressure controlled mechanism being responsive to a difference in fluid pressure upstream and downstream of the valve so that a closing force of the valve is added to the piston when said difference in fluid pressure is positive.

8. The valve according to claim 7, wherein the valve is provided with a leakage channel for allowing leakage through the valve when being in a closed position.

9. The valve according to claim 8, further provided with a biasing means configured for facilitating movement of the piston from a position wherein the valve is closed, to a position of the piston wherein the valve is open.

10. The valve according to claim 7, wherein the pressure-controlled mechanism further comprises a first leakage channel and a second leakage channel for communicating fluid upstream of the flow barrier to the pressure-controlled mechanism, wherein the second leakage channel is in fluid communication with a third inlet through the flow barrier, the third inlet arranged to be closed by means of the inflow control element when the content of undesired fluid in the fluid flow upstream of the flow barrier is below the predetermined level.

11. The valve according to claim 10, further comprising at least one secondary piston being axially movable with respect to the piston of the valve, wherein the first leakage channel and the second leakage channel are in fluid communication via a pressure communication channel influencing a position of the at least one secondary piston.

12. The valve according to claim 1, wherein the valve further comprises a secondary inflow control element located in the fluid flow upstream of the flow barrier, and a further secondary inlet through the flow barrier and in fluid communication with the secondary flow channel , the further secondary inlet being closable by the secondary inflow control element and arranged to open the further secondary inlet when the fluid upstream of the barrier comprises drilling fluid, and to close the further secondary inlet when the fluid upstream of the barrier does not comprise drilling fluid, the secondary inflow control element having a density higher than the density of a desired fluid and the undesired fluid, but lower than the density of the drilling fluid.

13. A system for controlling inflow of a fluid from a well and into a tubular body forming part of a production string, the system comprising at least one valve comprising:

a primary flow channel having a primary inlet through a flow barrier, and a low pressure portion;

a secondary flow channel connected to the primary flow channel at the low pressure portion, the secondary flow channel having a secondary inlet through the flow barrier and provided with a flow restrictor;

a chamber in connection with the secondary flow channel;

a piston arranged in the primary flow channel for opening and closing the primary flow channel, the piston defining a portion of the chamber in connection with the secondary flow channel;

an inflow control element movable between a first position and a second position in response to a density of a fluid;

wherein the inflow control element is exposed to the fluid flow upstream of the flow barrier and is arranged to move to the second position and close the secondary inlet when the content of the undesired fluid in the flow upstream of the flow barrier exceeds the predetermined level; and wherein the closing of the secondary inlet causes an underpressure in the chamber such that the piston is activated and the valve is closed;

wherein the system further comprises:

a diverting device arranged upstream of at least one of the at least one valve, the diverting device having an upstream end portion and a downstream end portion;

a flow through inlet in the upstream end portion;

a flow through conduit for allowing fluid communication from the flow through inlet to the downstream end portion;

a bypass inlet in the upstream end portion;

a bypass conduit for allowing fluid communication from the bypass inlet to an outlet arranged in fluid communication with an aperture in a wall of the production string , the outlet being arranged between the upstream end portion and the downstream end portion of the diverting device, the flow through inlet being spaced apart from the bypass inlet; and at least one diverting device inflow control element responsive to a density of a fluid;

wherein the diverting device inflow control element is located in the fluid flow at the upstream end portion of the diverting device and is arranged to block one of the flow through inlet and the bypass inlet depending on the density of the fluid at the upstream end portion of the diverting device.

14. The system according to claim 13, wherein the at least one diverting device inflow control element comprises:

a diverting device first inflow control element arranged to block the flow through inlet when the fluid is drilling fluid;

a diverting device second inflow control element arranged to block the bypass inlet when the fluid is oil, water and/or gas;

wherein the first diverting device inflow control element is arranged in a first path, and the diverting device second inflow control element is arranged in a second path being separate from the first path.

15. The system according to claim 13, wherein, in the position of use, the flow through inlet is arranged at a higher elevation than the bypass inlet, and the diverting device inflow control element is one element movable in a path extending between a first position and a second position, wherein the inflow control element in the first position is configured to block the flow through inlet, and in the second position is configured to block the bypass inlet.

16. The system according to claim 13, wherein the diverting device inflow control element has a density between that of drilling fluid and that of water.

17. The system according to claim 13, wherein the diverting device further comprises at least one leakage channel for allowing a leakage flow through the diverting device.

18. A method for controlling fluid flow in, into or out of a well, wherein the method comprises the steps of:

mounting at least one valve as part of a well completion string prior to inserting the string in the well, the at least one valve comprising:

a primary flow channel having a primary inlet through a flow barrier, and a low pressure portion;

a secondary flow channel connected to the primary flow channel at the low pressure portion, the secondary flow channel having a secondary inlet through the flow barrier and provided with a flow restrictor;

a chamber in connection with the secondary flow channel;

a piston arranged in the primary flow channel for opening and closing the primary flow channel, the piston defining a portion of the chamber in connection with the secondary flow channel;

an inflow control element movable between a first position and a second position in response to a density of a fluid;

wherein the inflow control element is exposed to the fluid flow upstream of the flow barrier and is arranged to move to the second position and close the secondary inlet when the content of the undesired fluid in the flow upstream of the flow barrier exceeds the predetermined level; and wherein the closing of the secondary inlet causes an underpressure in the chamber such that the piston is activated and the valve is closed;

bringing the well completion string into the well;

orienting the at least one valve within the well; and flowing fluid in, into or out of the well.

19. The method according to claim 18, wherein the method further comprises:

arranging a diverting device upstream of at least one of the at least one valve, the diverting device having:

an upstream end portion and a downstream end portion;

a flow through inlet in the upstream end portion;

a flow through conduit for allowing fluid communication from the flow through inlet to the downstream end portion;

a bypass inlet in the upstream end portion ;

a bypass conduit for allowing fluid communication from the bypass inlet to an outlet arranged in fluid communication with an aperture in a wall of the production string, the outlet being arranged between the upstream end portion and the downstream end portion of the diverting device, the flow through inlet being spaced apart from the bypass inlet; and at least one diverting device inflow control element responsive to a density of a fluid;

wherein the method comprises locating the diverting device inflow control element in the fluid flow at the upstream end portion of the diverting device and arranging the inflow control element to block one of the flow through inlet and the bypass inlet depending on the density of the fluid at the upstream end portion of the diverting device.

* * * * *